US006296997B1

(12) United States Patent
Romanet et al.

(10) Patent No.: US 6,296,997 B1
(45) Date of Patent: Oct. 2, 2001

(54) PHOTOGRAPHIC ELEMENT AND COMPOUND AND PROCESS USEFUL THEREWITH

(75) Inventors: Robert F. Romanet, Rochester; William B. Vreeland, Webster; John W. Harder; Christopher T. Brown, both of Rochester; Scott R. Conley; Michael P. Youngblood, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/707,586

(22) Filed: Nov. 7, 2000

(51) Int. Cl.[7] ..... G03C 1/08; G03C 7/26; G03C 7/32

(52) U.S. Cl. ..... 430/558; 430/386; 430/387

(58) Field of Search ..... 430/502, 543, 430/558, 386, 387

(56) References Cited

U.S. PATENT DOCUMENTS

| | | | | |
|---|---|---|---|---|
| 5,254,451 | * | 10/1993 | Kita et al. | 430/558 |
| 5,609,996 | | 3/1997 | Tang et al. . | |
| 5,925,503 | | 7/1999 | Harder et al. . | |
| 5,972,587 | * | 10/1999 | Romanet et al. | 430/558 |
| 5,985,533 | | 11/1999 | Romanet et al. . | |

FOREIGN PATENT DOCUMENTS

| | | | |
|---|---|---|---|
| 5158198 | * | 6/1993 | (JP) . |
| 8146575 | * | 6/1996 | (JP) . |
| 10142757 | * | 5/1998 | (JP) . |
| 10186603 | * | 7/1998 | (JP) . |

* cited by examiner

*Primary Examiner*—Geraldine Letscher
(74) *Attorney, Agent, or Firm*—Arthur E. Kluegel

(57) ABSTRACT

Disclosed is a photographic element comprising a light-sensitive silver halide emulsion layer having associated therewith a bicyclic azole dye-forming coupler compound having Formula I:

I wherein:

BA represents a bicyclic azole coupler nucleus with —$(C(R^1)(R^2))_P$— bonded to a ring carbon in a non-coupling position of the coupler nucleus;

p is 1 or 2, and each $R^1$ and $R^2$ is independently selected from H and a substituent group, provided that any two of $R^1$ and $R^2$ may join to form a ring;

$R^a$ and $R^b$ are each independently selected from H and a substituent group, provided that substituent groups may join to form a ring;

each Y is an independently selected substituent and m is 0–4;

X is selected from the group consisting of —C(O)—, —$S(O)_2$—, —S(O)—, and —P(O)(OH)—;

W is a connecting group having a chain of up to four atoms between X and Z, and n=0 or 1; and a) when n=0, Z is —$NHR^5$ where $R^5$ is H or a substituent, and b) when n=1, Z is selected from —OH, —$SO_2NHR^5$, and —$NHR^6$ where $R^5$ is H or a substituent group and $R^6$ is a substituent bonded to —NH— by an electron withdrawing group in $R^6$;

provided that the ClogP value of the coupler compound is at least 5.0.

The element provides improved color rendition.

25 Claims, No Drawings

PHOTOGRAPHIC ELEMENT AND COMPOUND AND PROCESS USEFUL THEREWITH

CROSS-REFERENCE TO RELATED APPLICATIONS

Co-filed herewith is an application under Docket 78617 employing a bicyclic azole coupler in a silver halide photographic element for improved image dye stability.

FIELD OF THE INVENTION

This application describes a silver halide photographic element containing a dye-forming bicyclic azole coupler having a certain substituent group bearing a phenoxy group containing a desirable ortho substituent for improved color rendition.

BACKGROUND OF THE INVENTION

The pyrazolone couplers often used in silver halide photographic elements such as color reversal films exhibit rather broad dye hue, unwanted blue absorption and are reliant upon formaldehyde stabilization for image permanence. Bicyclic azole couplers including pyrazolotriazole couplers such as 1H-pyrazolo-[5,1-c]-1,2,4-triazoles and 1H-pyrazolo-[1,5-b]-1,2,4-triazoles are attractive couplers to replace these pyrazolone couplers because they yield narrower dye hue, better thermal stability without reliance upon formaldehyde and less unwanted absorption.

Because image dyes with narrow-bandwidth spectral absorption afford less unwanted absorption (i.e. absorption of light in the "wrong" regions of the visible portion of the electromagnetic radiation") than broader band pyrazolone couplers, improved color rendition is more readily achieved. Excessive image-dye unwanted spectral absorptions can cause colors to be reproduced darker and to exhibit lower colorfulness than in the original scene unless compensations are made in other aspects of the film affecting color reproduction. Various means have been used typically in photographic color reversal films to overcome the color reproduction effects of unwanted spectral absorptions of image dyes. Such means can include increases in the contrast of reproduced images relative to the original scene, which generally improves the colorfulness of reproduced colors, but can be at the expense of tone reproduction. That is, the dark parts of the reproduced image can appear too dark and the light parts of the reproduced image can appear too light. Further means for overcoming the color reproduction effects of image-dye unwanted absorptions can include widely separating the film's red-light, green-light, and blue-light spectral sensitivity characteristics along the visible wavelength axis, which again generally improves the colorfulness of reproduced colors, but this can be at the expense of inducing errors in reproduced hue and lightness. For example, one trade-off of widely separated film spectral sensitivities is that metameric colors in an original scene (i.e. visually-matched color stimuli having different spectral compositions) may no longer look alike in the reproduction. Still further means for overcoming the color reproduction deficiencies of image-dye unwanted absorptions can include incorporation of high levels of inter-image effects in order to obtain satisfactory color reproduction, but these high levels may well be difficult or impossible to achieve. Typically a combination of means for overcoming the color reproduction deficiencies of image-dye unwanted spectral absorptions is incorporated in photographic color films and is adjusted so that color-reproduction trade-offs are minimized, insofar as possible, for colors regarded as those most often encountered in practice and weighted according to their relative importance and to the tolerance of different types of trade-offs for those colors.

A photographic color film having an image dye with narrow spectral absorption bandwidth would have the advantage of exhibiting to a lesser degree the aforementioned color reproduction deficiencies associated with excessive unwanted spectral absorptions, and thus require less of the aforementioned color-reproduction compensations. A further advantage of such a film then is that, by requiring a lesser degree of color-reproduction compensations, the aforementioned color-compensation tradeoffs are induced to a lesser extent, resulting in reproduced images regarded generally as having improved color reproduction compared to films known in the art having image dyes of broad spectral bandwidth.

It is not uncommon for the images reproduced on photographic color films to in turn serve as original images in subsequent imaging operations such as in the production of duplicate photographic transparency images, the production of photographic color reversal reflection prints, the production of photographic color inter-negatives, and in the scanning of said photographic color film images for digital imaging operations carried out on computers.

U.S. Pat. Nos. 5,609,996 and 5,985,533 suggest employing certain pyrazolo azole couplers that are useful for producing magenta dyes having improved dye light stability.

Commercially available photographic color reversal film duplicating media and scanning devices have spectral sensitivity or spectral response characteristics and associated chemical or digital color-signal processing optimized for use with commercially available input photographic color reversal film originals having pyrazolone couplers. Thus an improved photographic color reversal film with narrower bandwidth magenta dye and reduced color-compensation trade-offs may not function compatibly with said photographic color reversal film duplicating media and scanning devices. For example, a grayscale produced on a color reversal film with narrower bandwidth magenta dye may produce different color-balance or color-contrast results when duplicated or scanned using the aforementioned existing photographic duplicating media or scanning devices than would a visually matched grayscale produced on a commercially available input photographic color reversal film having pyrazolone couplers would using said photographic duplicating media or scanning devices. Therefore compatibility of the narrow bandwidth magenta dye with a given pair of cyan and yellow dyes requires more attention to the choice of magenta absorption maximum wavelength, $\lambda$max, than with a broad magenta dye. That is, to be compatible with a broad range of color scanners and commercially available color reversal film duplicating media, the narrow bandwidth magenta dye $\lambda$max must be carefully chosen. Due to the combined requirements of color reproduction in the original film, color reproduction of subsequent duplication processes of the original film, and color-film scanner compatibility, a magenta dye with the following spectral features would be useful for many applications such as color reversal applications:

- spectral half-bandwidths in the range 72–84 nm and more preferably 76–82 nm, and
- a $\lambda$max value in the range of 553–560 nm and more preferably 554–558 nm.

Color reversal films commonly contain relatively high silver halide levels and are processed in such a way that the dye yield (moles of dye formed per mole of reduced silver) is significantly less than 100%. The low dye yield affords images with low graininess, and is caused by components present in the color developer that compete with the image coupler for oxidized developer. The competing components include hydroxide ion, present in relatively high concentration due to the higher pH of the color developer employed in reversal processing.

As a consequence of the relatively high color developer pH, color reversal films, typically exhibit a negative dependence of dye density on developer pH. That is, negative slopes of $D_{max}$ vs. color developer pH are common in color reversal systems. This negative slope is caused by the reaction of oxidized developer with hydroxide ion which competes with the dye-forming reaction of oxidized developer with image couplers possessing low $pK_a$. In a color reversal film, a magenta coupler that exhibits a positive pH dependence is likely to cause color balance shifts under conditions of variable developer pH if the cyan and yellow couplers have the typically negative pH dependencies. If the cyan and yellow couplers employed exhibit negative pH sensitivities, as they commonly do, a bicyclic azole coupler which also exhibits a negative slope would be desirable. Unfortunately, it is common for couplers of this class to exhibit a positive slope in plots of $D_{max}$ vs. color developer pH, presenting a disadvantage for use in color reversal films.

An optimal color reversal film would have couplers in all three color records that are pH insensitive. Therefore, magenta couplers with flat pH sensitivity are also desirable. The couplers of this invention possess color developer pH sensitivities that exhibit either a small negative slope or a very slight positive slope. Those with negative pH sensitivity can be combined with common color reversal cyan and yellow couplers that typically exhibit matching negative sensitivities. Those magenta couplers that have virtually flat pH sensitivity could be combined with matching pH-insensitive cyan and yellow couplers. The green $D_{max}$ obtained for a film processed in a pH 11.60 color developer is subtracted from the green $D_{max}$ for the same film processed in a pH 12.20 color developer to yield a $\Delta D_{max}$ metric. For the present invention, the coupler structures achieve pH sensitivities commonly in the range −0.30 to +0.10. Useful magenta couplers with negative pH sensitivities possess $\Delta D_{max}$ nominally in the range of −0.30 to −0.10, while useful magenta couplers with "flat" pH sensitivities possess $\Delta D_{max}$ in the range of −0.10 to +0.10.

A problem to be solved is to provide a silver halide photographic element that produces images having improved color rendition.

SUMMARY OF THE INVENTION

The invention provides a photographic element comprising a light-sensitive silver halide emulsion layer having associated therewith a bicyclic azole dye-forming coupler compound having Formula I:

I

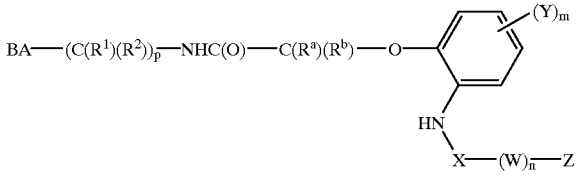

wherein:

BA represents a bicyclic azole coupler nucleus with $—(C(R^1)(R^2))_p—$ bonded to a ring carbon in a non-coupling position of the coupler nucleus;

p is 1 or 2, and each $R^1$ and $R^2$ is independently selected from H and a substituent group, provided that any two of $R^1$ and $R^2$ may join to form a ring;

$R^a$ and $R^b$ are each independently selected from H and a substituent group, provided that substituent groups may join to form a ring;

each Y is an independently selected substituent and m is 0–4;

X is selected from the group consisting of —C(O)—, $—S(O)_2—$, —S(O)—, and —P(O)(OH)—;

W is a connecting group having a chain of up to four atoms between X and Z, and n=0 or 1; and a) when n=0, Z is $—NHR^5$ where $R^5$ is H or a substituent, and b) when n=1, Z is selected from —OH, $—SO_2NHR^5$, and $—NHR^6$ where $R^5$ is H or a substituent group and $R^6$ is a substituent bonded to —NH— by an electron withdrawing group in $R^6$;

provided that the ClogP value of the coupler compound is at least 5.0.

The invention further provides a coupler compound and an imaging method. Photographic elements of the invention provide improved color rendition.

DETAILED DESCRIPTION OF THE INVENTION

The invention is generally described above.

A variety of dye-forming coupler types have been used in photographic materials. Among the known dye-forming couplers are bicyclic azoles that contain an azole ring having a second azole ring fused thereto such as pyrazolotriazoles, pyrazolobenzimidazoles, and imidazopyrazoles. These couplers contain bridgehead nitrogen 5,5 fused ring systems and include such couplers as pyrrolo[1,2-b]pyrazoles, pyrazolo[5,1-c][1,2,4]triazoles, pyrazolo[1,5-b][1,2,4]triazoles, imidazo[1,2-b]pyrazoles, imidazo[1,5-b]pyrazoles, imidazo[1,2-a]imidazoles, imidazo[1,2-b][1,2,4]triazoles, imidazo[2,1-c][1,2,4]triazoles, imidazo[5,1-c][1,2,4]triazoles and [1,2,4]triazolo[3,4-c][1,2,4]triazole. These couplers also contain bridgehead nitrogen 5,5,6 fused ring systems and include compounds such as pyrazolo[3,2-b]benzimidazoles. These couplers may form magenta or cyan dyes, depending on the ring structure and substituents. Preferred couplers are bicyclic azoles represented by the Formula M:

M

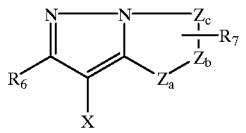

wherein:

$R_6$ is hydrogen, a substituent group or a ballast group;

$R_7$ is a ballast group or a fused benzene ring; and

X is hydrogen or a coupling-off-group, provided that X, $R_6$ and $R_7$ contain a number of carbons sufficient to immobilize the coupler in the emulsion layer; and $Z_a$, $Z_b$, and $Z_c$ are independently a substituted or unsubstituted methine group,

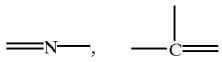

or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it can be part of an aromatic ring and at least one of $Z_a$, $Z_b$, and $Z_c$ represents a methine group connected to $R_7$. These couplers generally form magenta dyes when $R_6$ and $R_7$ are electron donating groups, and cyan dyes when $R_6$ and $R_7$ are electron withdrawing groups.

The present invention relates to couplers of the bicyclic azole type with a substituent group in a non-coupling position as shown in Formula I.

Each $R^1$ and $R^2$ group is an independently selected hydrogen, alkyl, or aryl group and two may join to form a ring. Suitably they are H or alkyl and desirably each is a methyl group. p is 1 or 2 with a value of 2 being preferred.

The $R^a$ and $R^b$ groups are independently selected hydrogen, alkyl, or aryl groups and they may join to form a ring. Suitably they are H or alkyl or one of each, and desirably both are H. The alkyl group may conveniently be a group of 4 or more carbon atoms that serves to help ballast the coupler in the coupler solvent in which it is dispersed.

The Y groups are optional substituents and there may be from 0- to 4 of them.

X is a group linking —NH— and W or Z. X is selected from the group consisting of —C(O)—, —$S(O)_2$—, —S(O)—, and —P(O)(OH)—. The groups are typically —C(O)— or —$S(O)_2$—, and conveniently —C(O)—.

W is a group linking X and Z. "n" is either 0 or 1 indicating either the absence or presence of the group. When present, W contains from 1 to 4 atoms in the chain linking X and Z. There may be side chains and substituent groups. Conveniently, W is an arylene group or alkylene group such as methylene or ethylene.

Suitable groups for Z depend on the value of n. When n is 0, Z is —$NHR^5$ where $R^5$ is H or a substituent. Convenient $R^5$ substituents are alkyl, aryl, sulfonyl, carbonyl, and carbamoyl groups. When n is 1, then $R^5$ may be —OH, —$S(O)_2NHR^5$, or —$NHR^6$. $R^5$ is H or a substituent, and convenient $R^5$ substituents are alkyl, aryl, sulfonyl, carbonyl, and carbamoyl groups, particularly phenyl and alkyl groups. $R^6$ is a substituent bonded to —NH— by an electron withdrawing group. For purposes of this definition, an electron withdrawing group is one for which the Hammett's Sigma Para value is at least 0.2. Such values may be found, for example, in C. Hansch and A. J. Leo in *Substituent Constants for Correlation Analysis in Chemistry and Biology* Wiley, N.Y., (1979). Suitable such electron withdrawing groups include sulfonyl and carbonyl groups, though others may be used. The balance of $R^6$ may conveniently be a phenyl or alkyl group, for example.

Also, when n is 1, Z may be a hydroxy group. As indicated, the chain length of W from X to Z is not more than 4 atoms. Finally, the group Z may be —$S(O)_2NHR^5$ when n is 1. It appears that the presence of the —$S(O)_2$— group in this substituents allows $R^5$ to be any substituent rather than one bonded by an electron withdrawing group.

Table I provides examples of couplers useful in the invention.

TABLE I

EXAMPLE COUPLERS

M-1

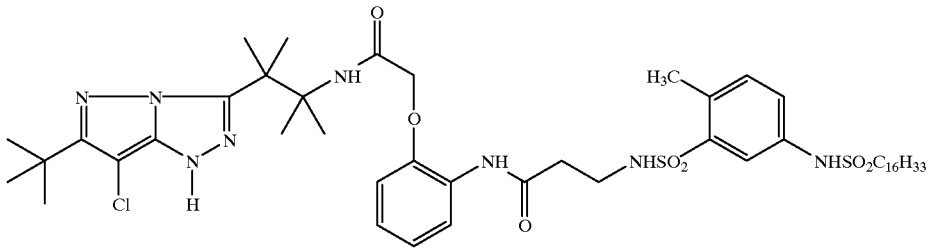

M-2

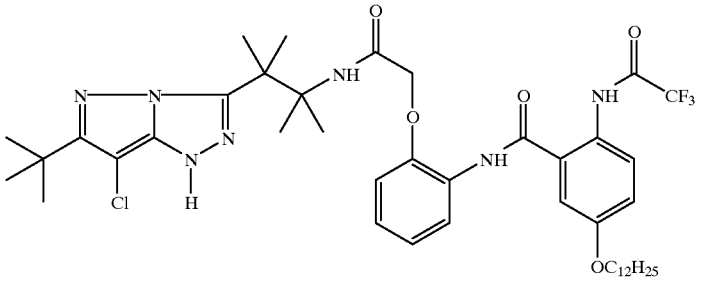

TABLE I-continued
| EXAMPLE COUPLERS |
|---|
| M-3 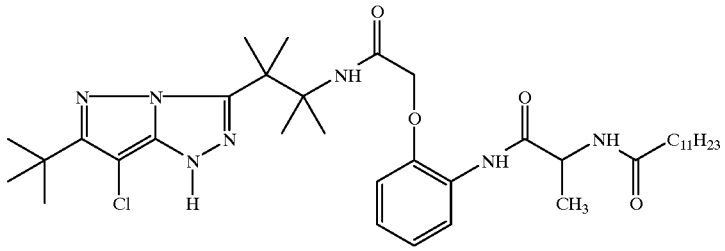 |
| M-4 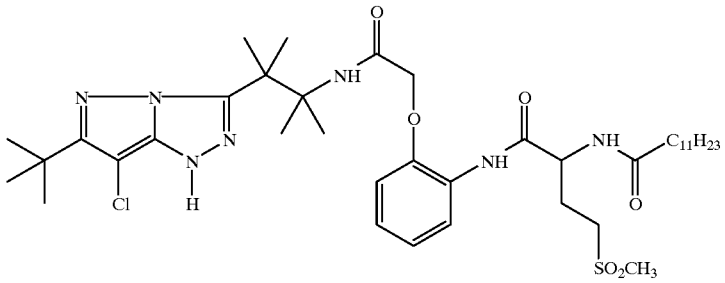 |
| M-5 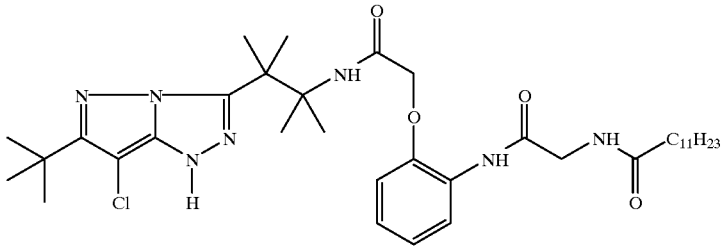 |
| M-6 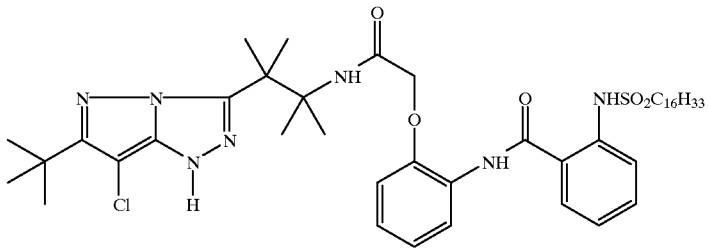 |
| M-7 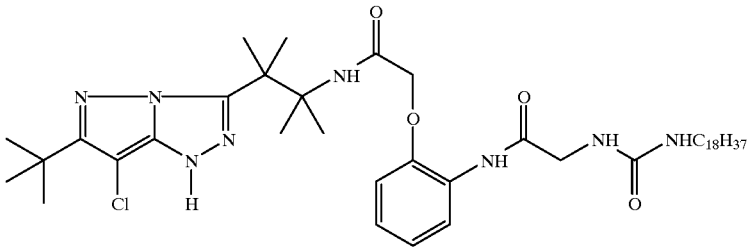 |

TABLE I-continued
| EXAMPLE COUPLERS |
|---|
| M-8 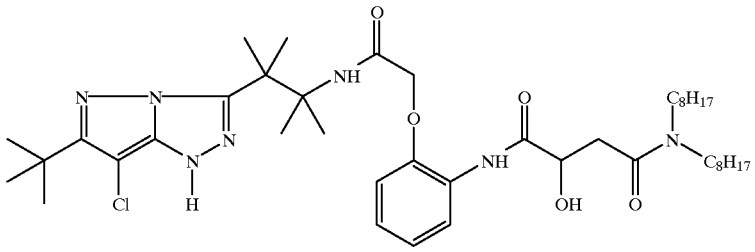 |
| M-9 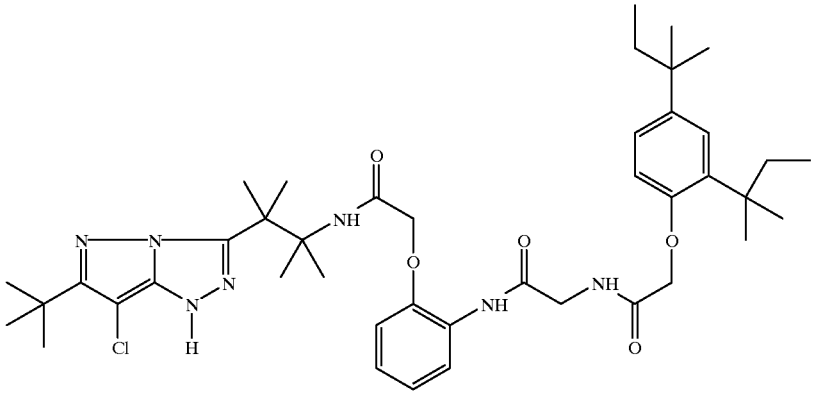 |
| M-10 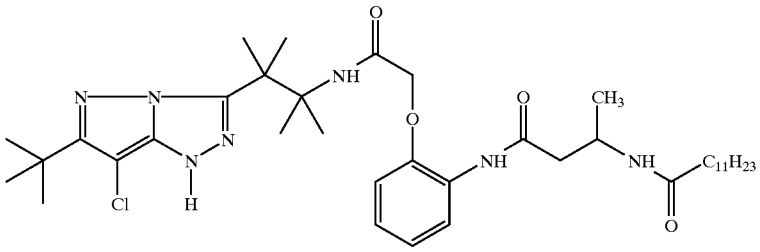 |
| M-11 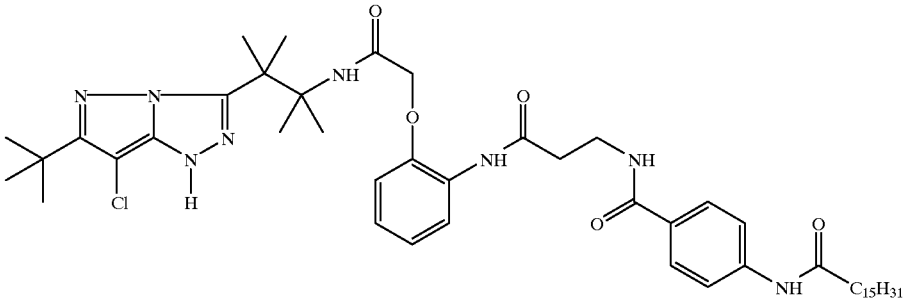 |

TABLE I-continued
| EXAMPLE COUPLERS |
|---|
| M-12 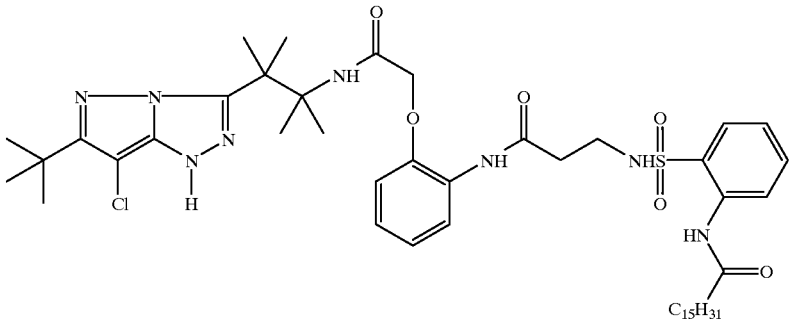 |
| M-13 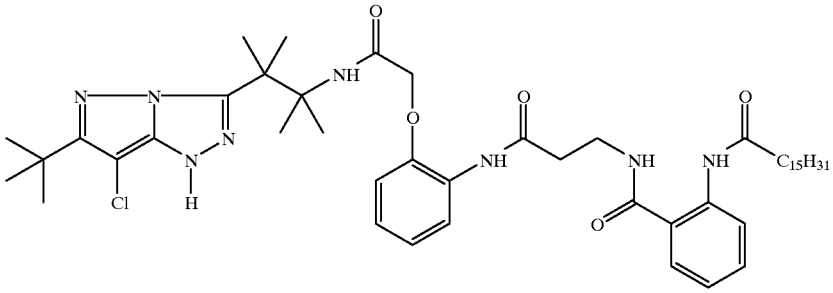 |
| M-14 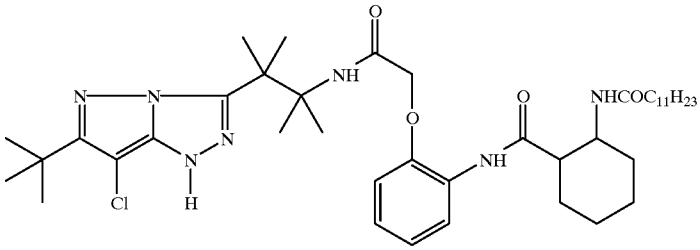 |
| M-15 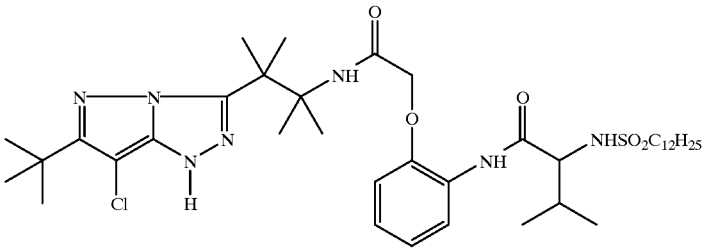 |
| M-16 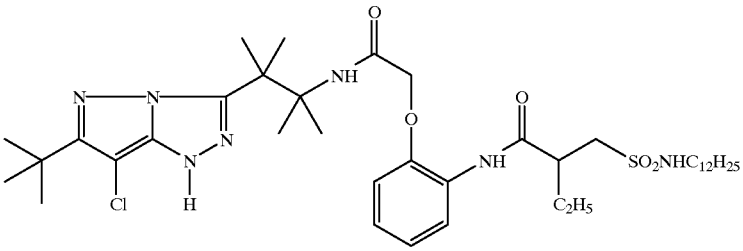 |

TABLE I-continued
| EXAMPLE COUPLERS |
|---|
| M-17 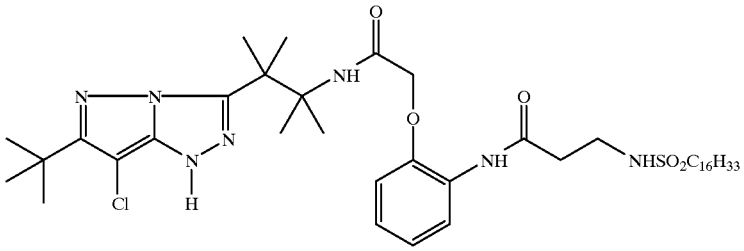 |
| M-18 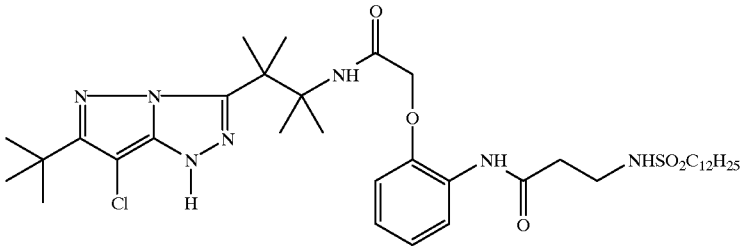 |
| M-19 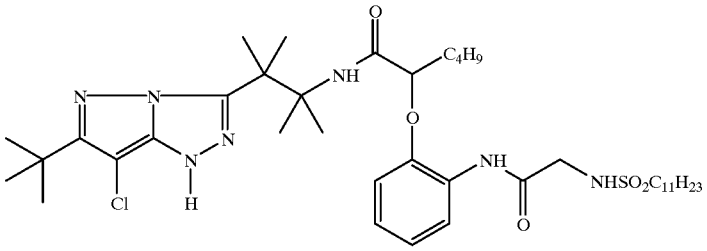 |
| M-20 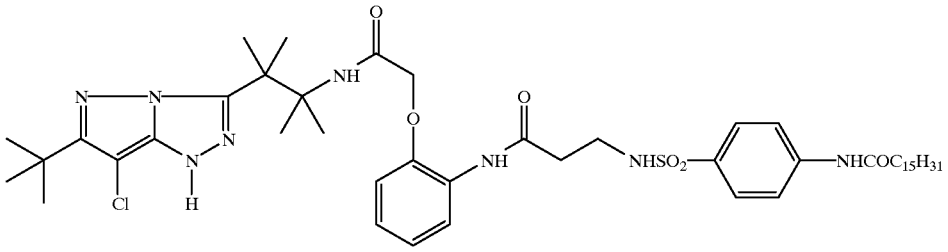 |
| M-21 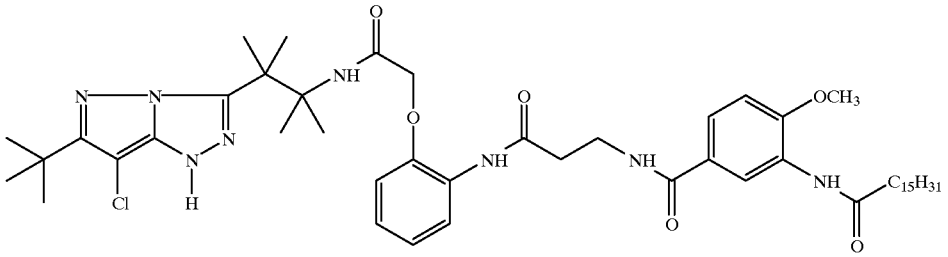 |

TABLE I-continued
| EXAMPLE COUPLERS |
|---|
| M-22 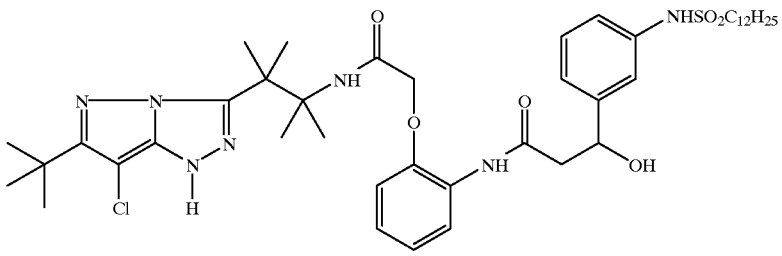 |
| M-23 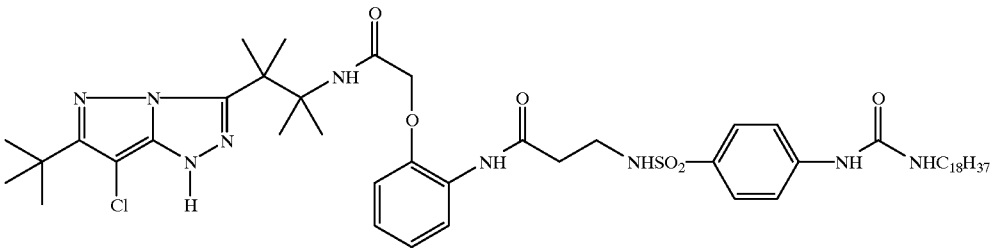 |
| M-24 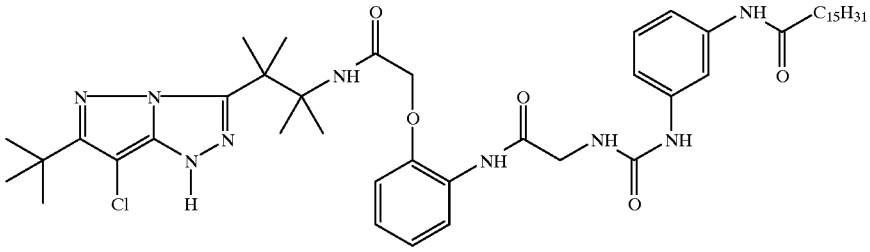 |
| M-25 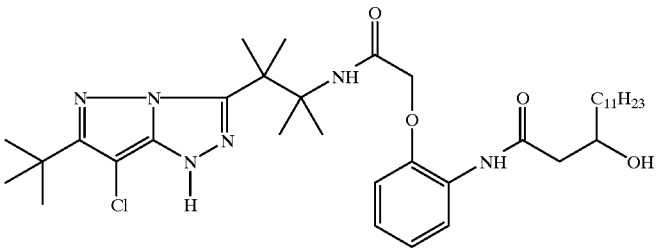 |
| M-26 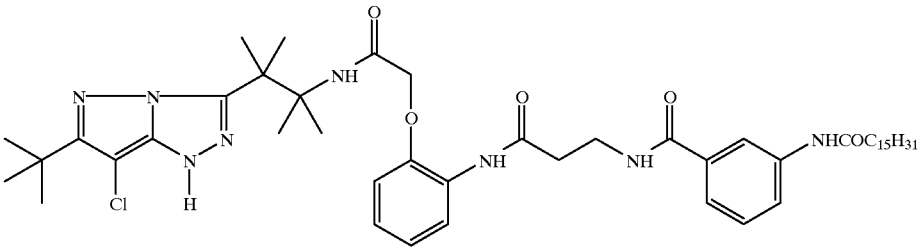 |

TABLE I-continued
| EXAMPLE COUPLERS |
|---|
| M-27 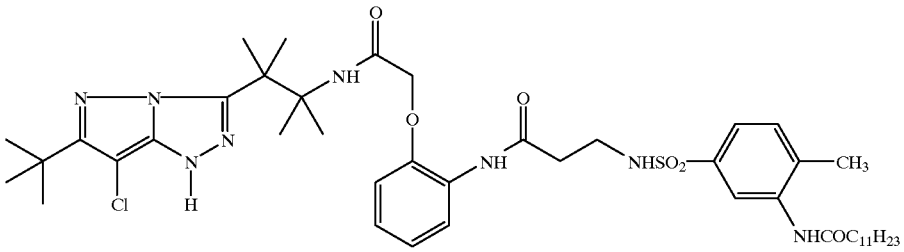 |
| M-28 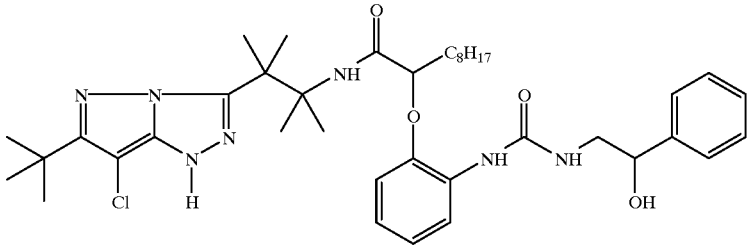 |
| M-29 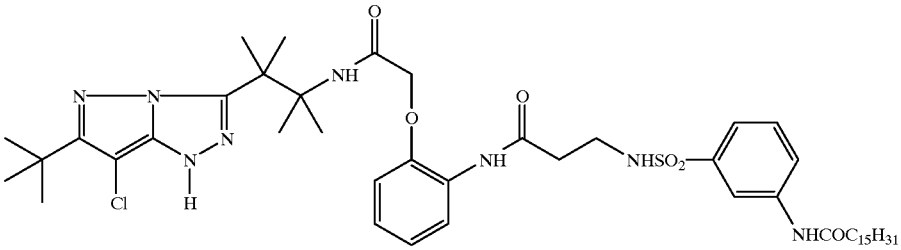 |
| M-30 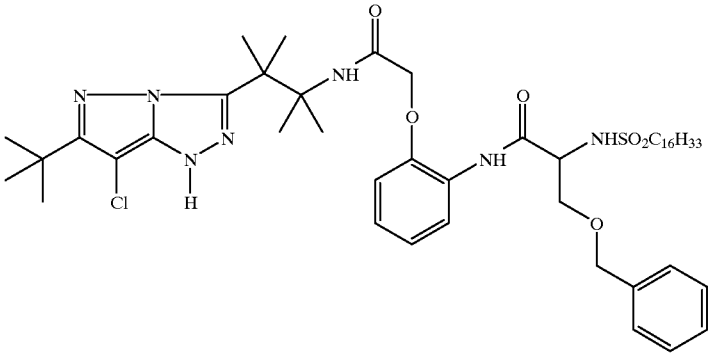 |
| M-31 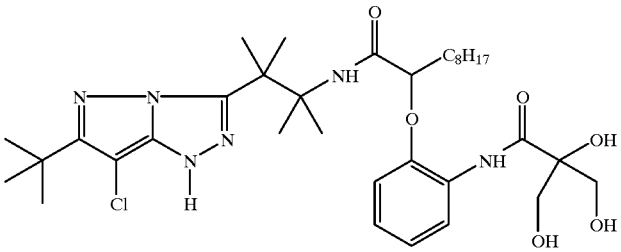 |

TABLE I-continued
| EXAMPLE COUPLERS |
|---|
| M-32 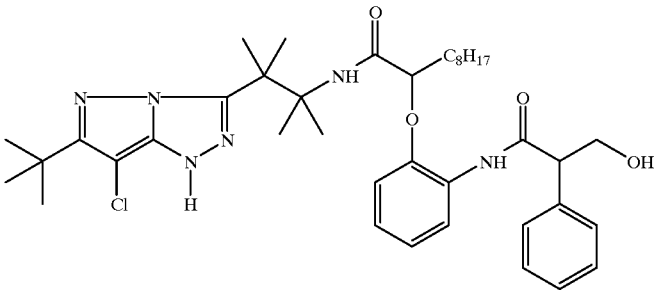 |
| M-33 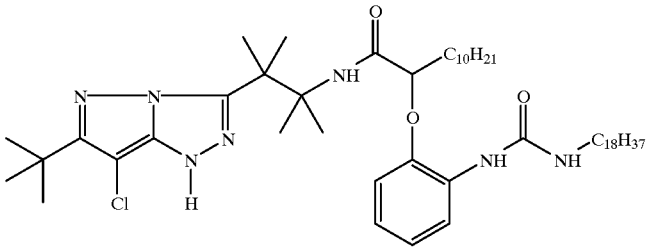 |
| M-34 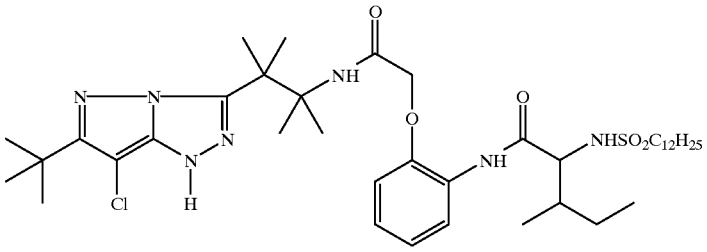 |
| M-35 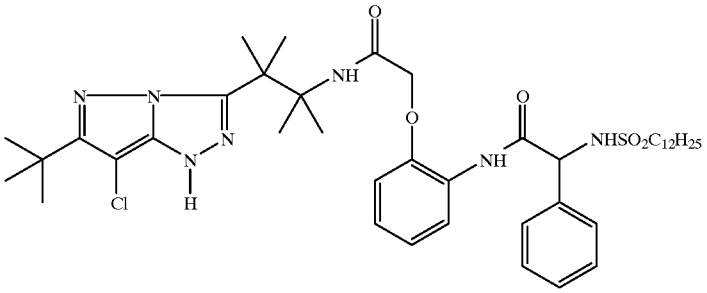 |
| M-36 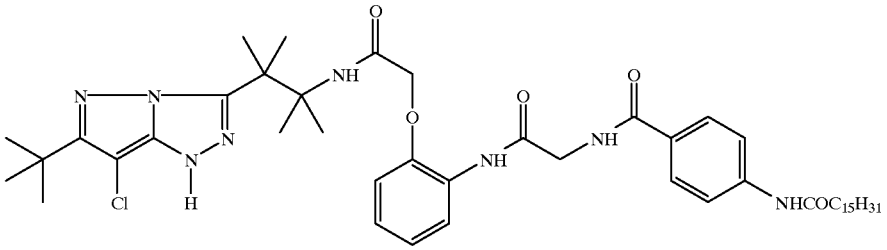 |

TABLE I-continued
| EXAMPLE COUPLERS |
|---|
| M-37 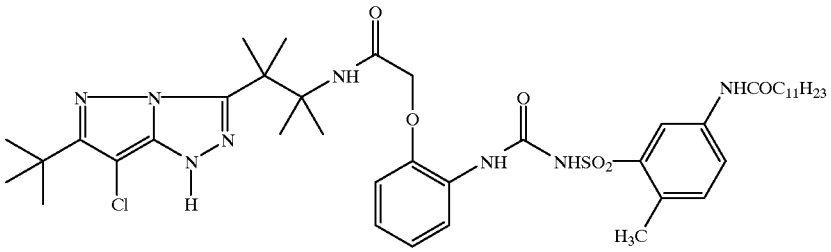 |
| M-38 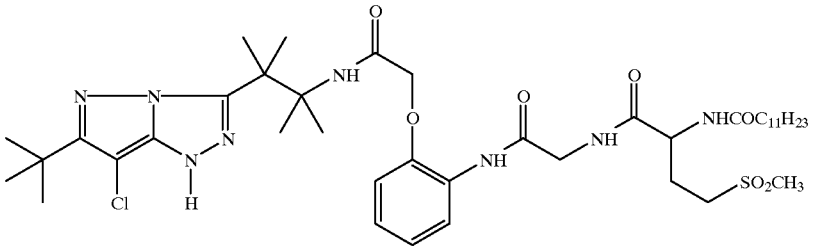 |
| M-39 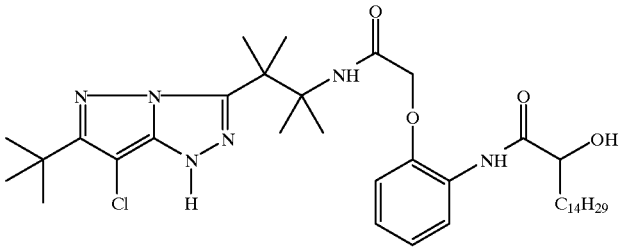 |
| M-40 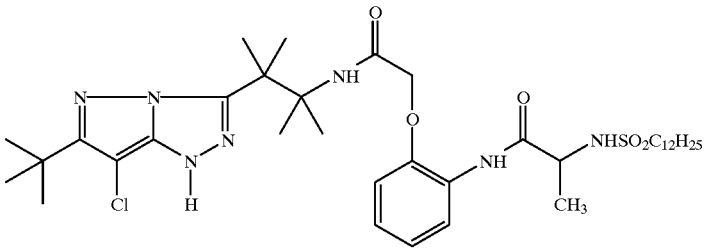 |
| M-41 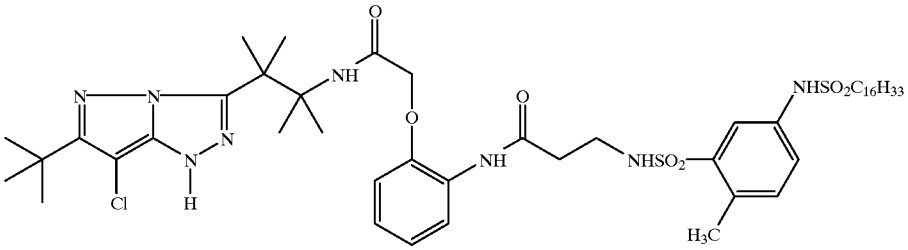 |

TABLE I-continued
| EXAMPLE COUPLERS |
|---|
| M-42 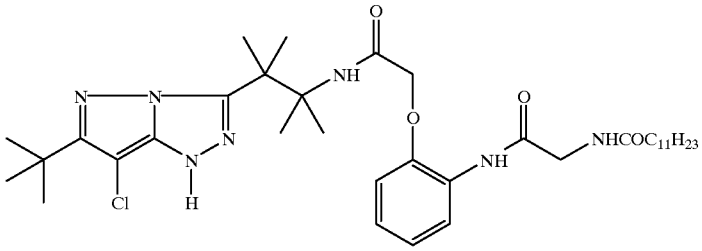 |
| M-43 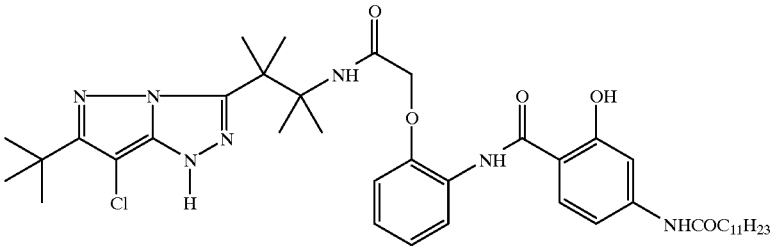 |
| M-44 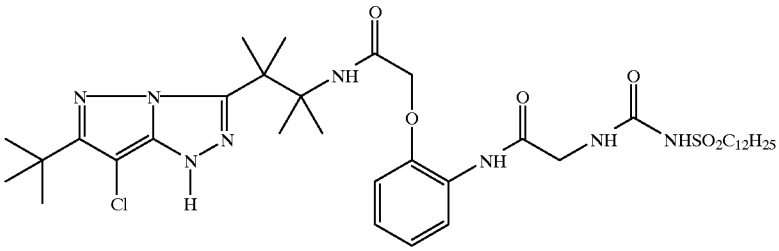 |
| M-45 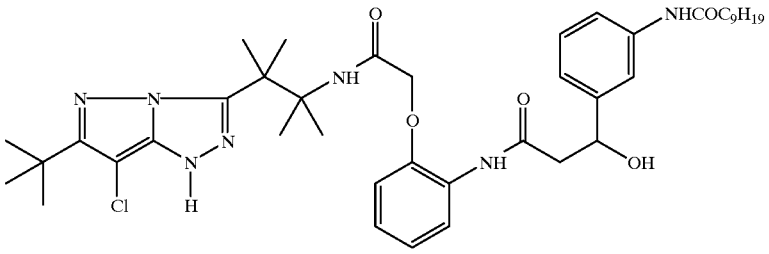 |
| M-46 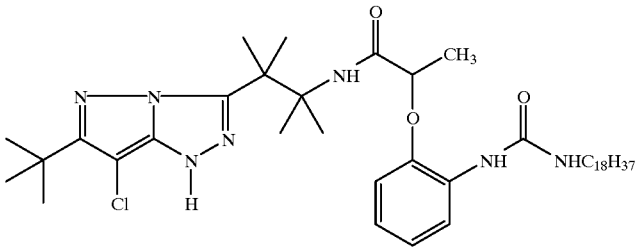 |

TABLE I-continued
| EXAMPLE COUPLERS |
|---|
| M-47 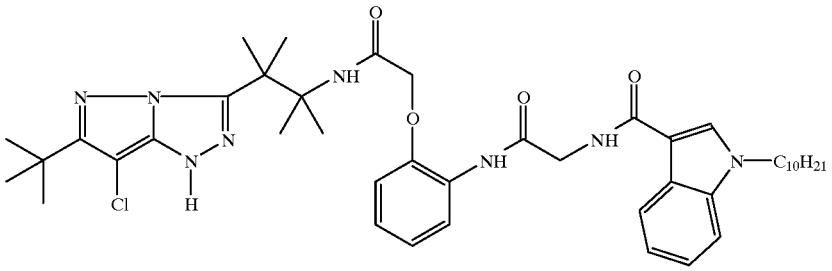 |
| M-48 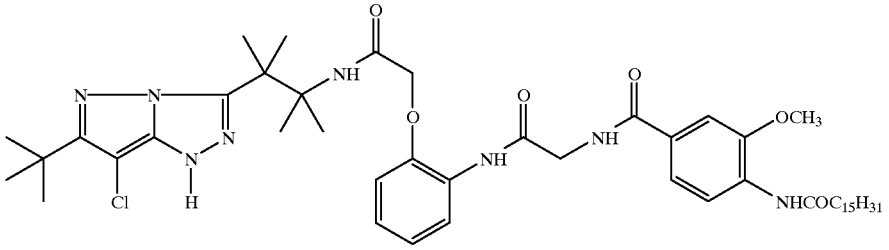 |
| M-49 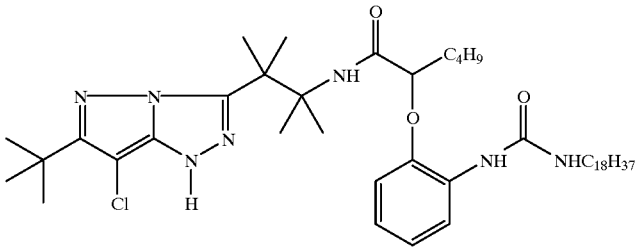 |
| M-50 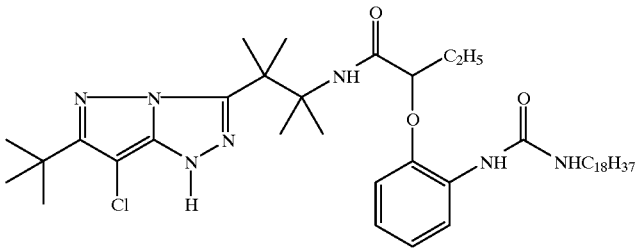 |
| M-51 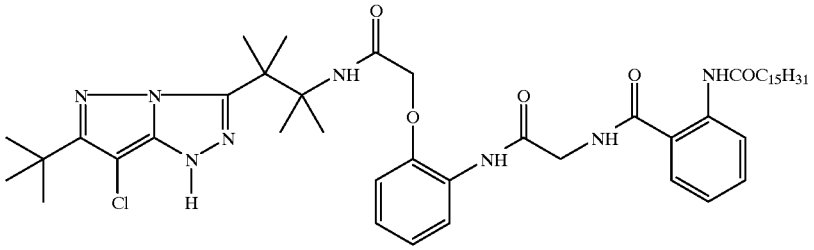 |

TABLE I-continued
| EXAMPLE COUPLERS |
|---|
| M-52 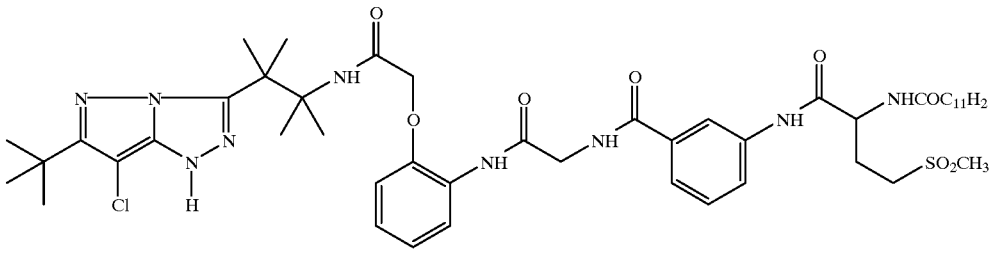 |
| M-53 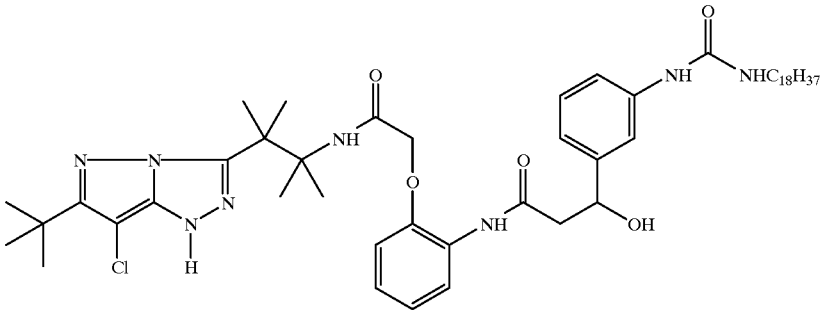 |
| M-54 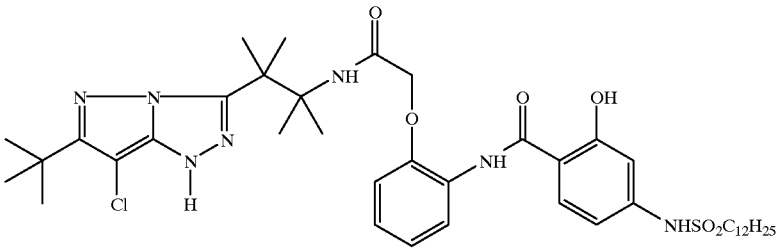 |
| M-55 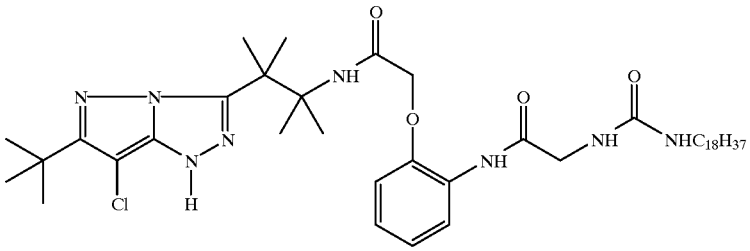 |
| M-56 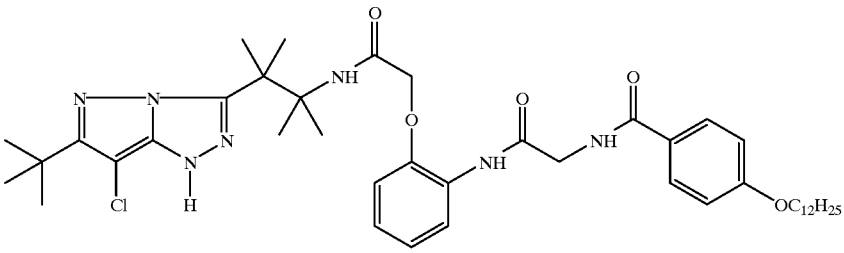 |

TABLE I-continued
| EXAMPLE COUPLERS |
|---|
| M-57 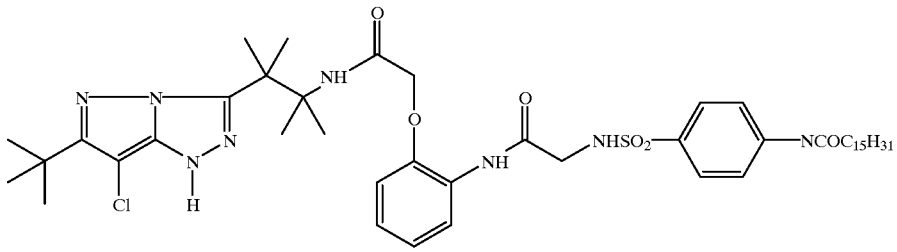 |
| M-58 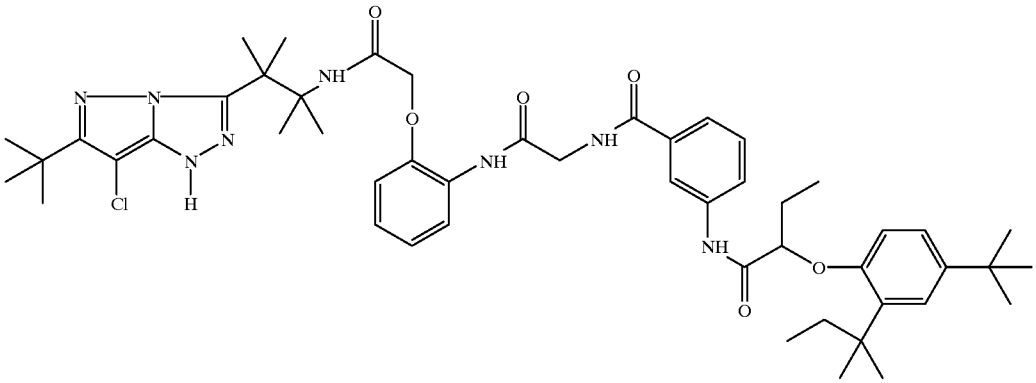 |
| M-59 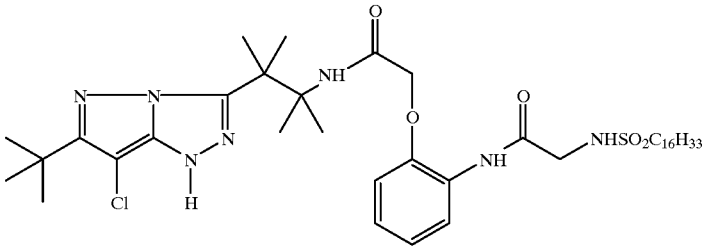 |
| M-60 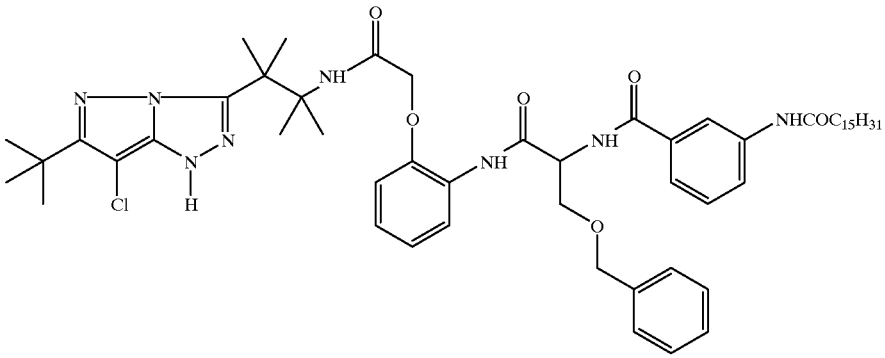 |

TABLE I-continued
| EXAMPLE COUPLERS |
|---|
| M-61 |
| 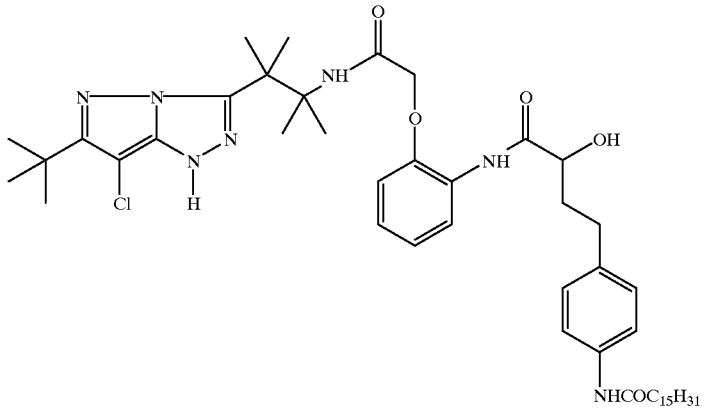 |
| M-62 |
| 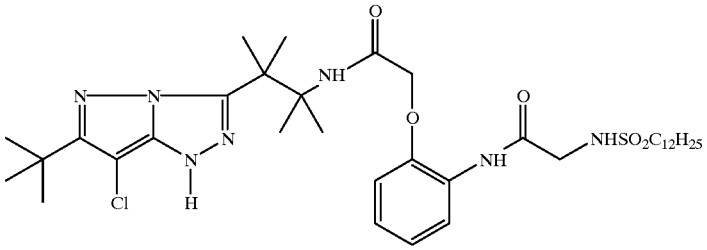 |
| M-63 |
| 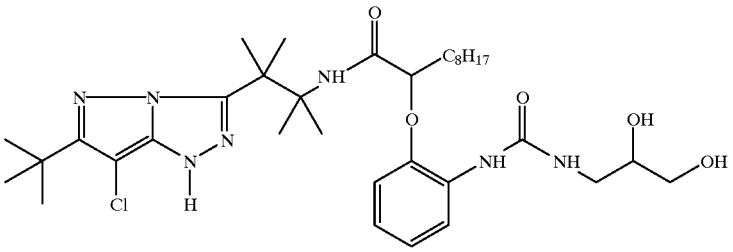 |
| M-64 |
| 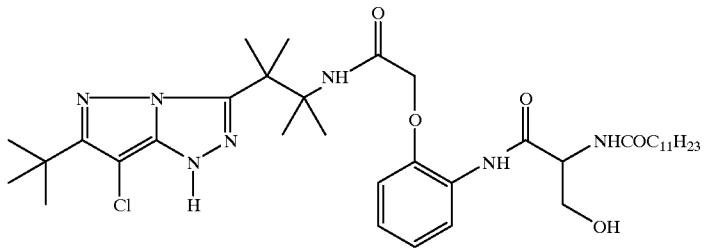 |
| M-65 |
| 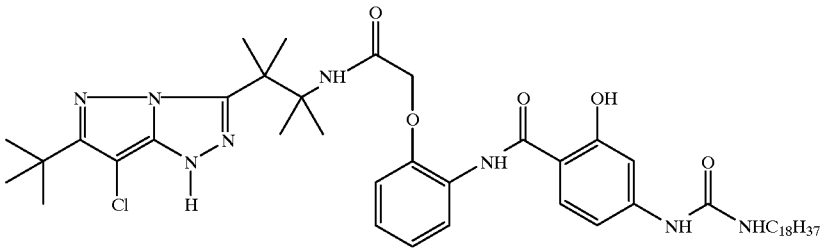 |

TABLE I-continued
| EXAMPLE COUPLERS |
|---|
| M-66 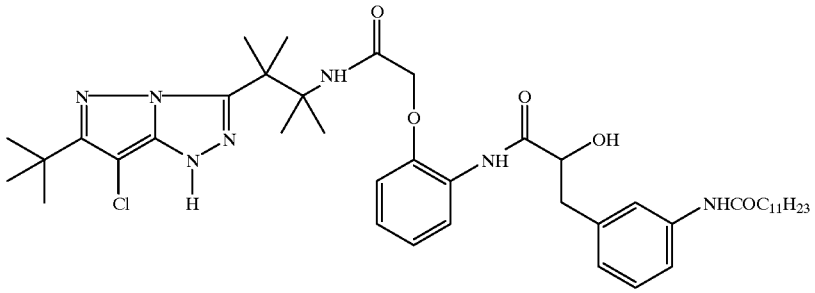 |
| M-67 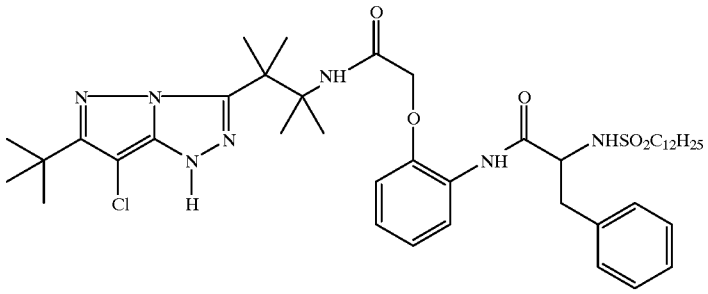 |
| M-68 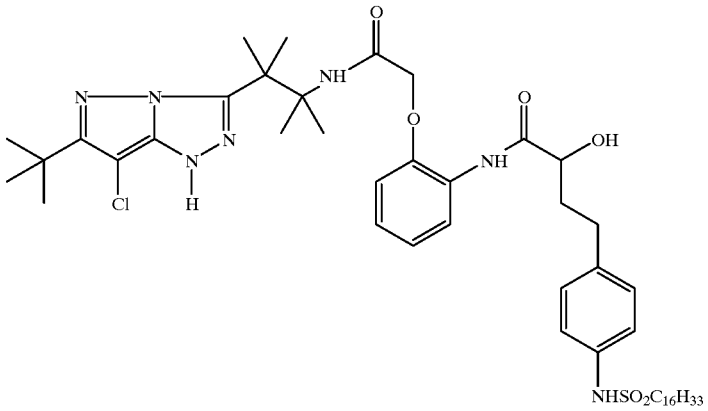 |
| M-69 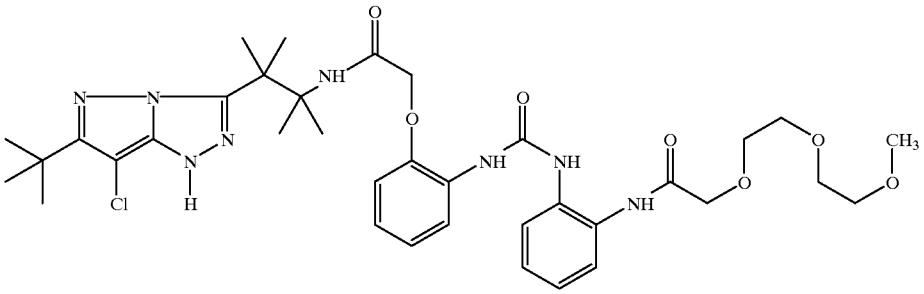 |

TABLE I-continued
| EXAMPLE COUPLERS |
|---|
| M-70 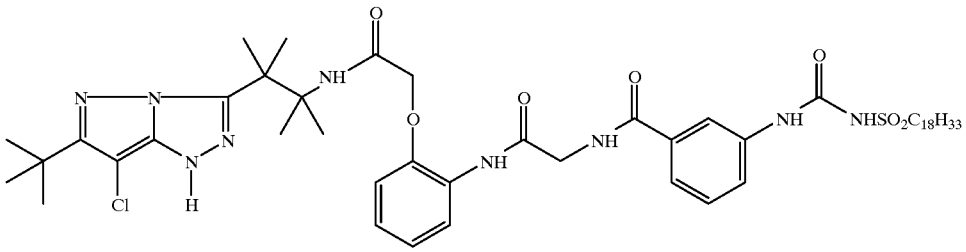 |
| M-71 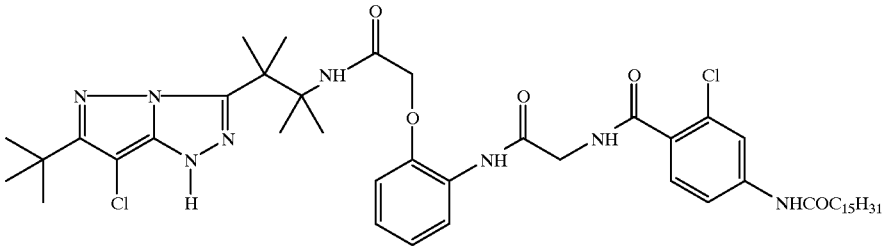 |
| M-72 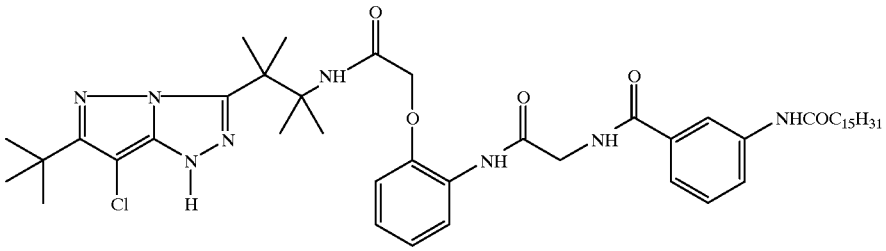 |
| M-73 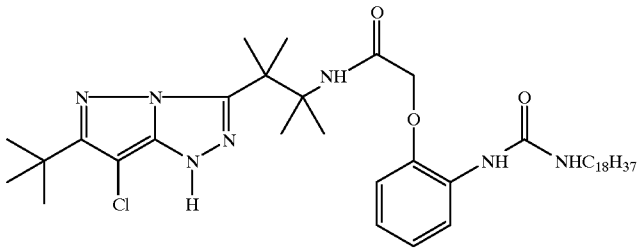 |
| M-74 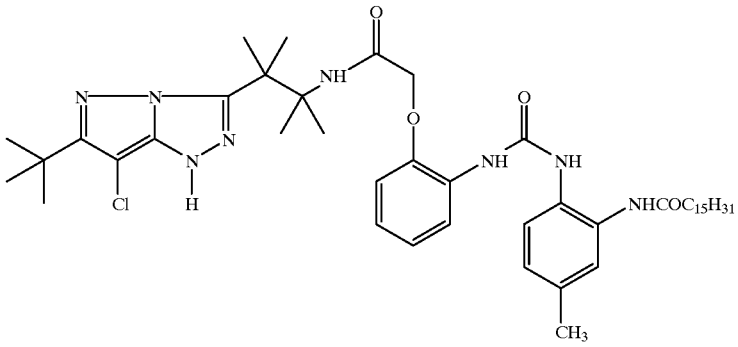 |

TABLE I-continued
| EXAMPLE COUPLERS |
|---|
| M-75 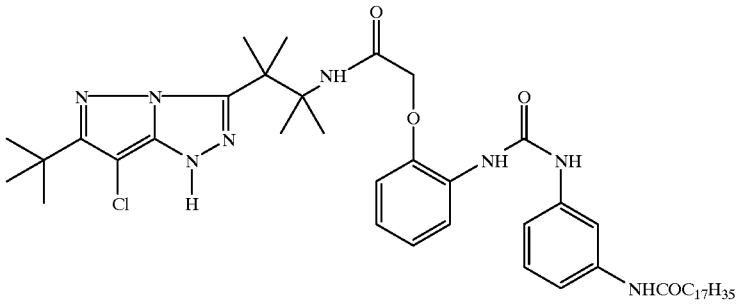 |
| M-76 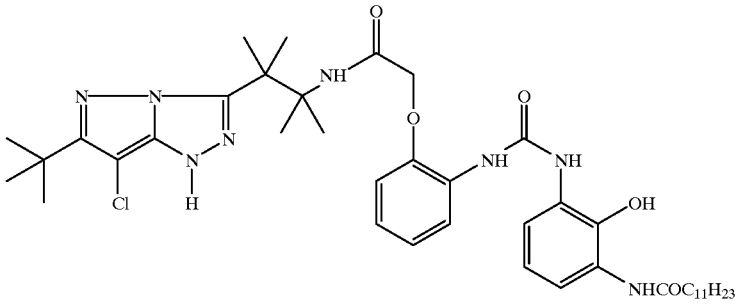 |
| M-77 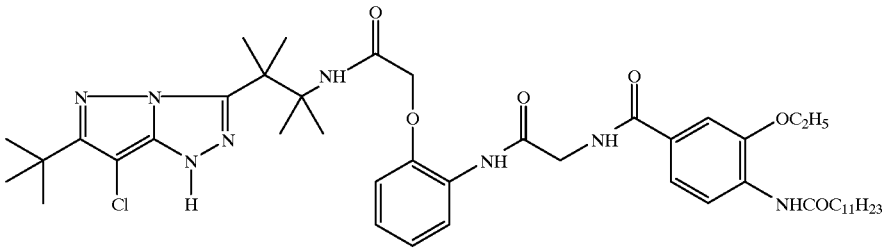 |
| M-78 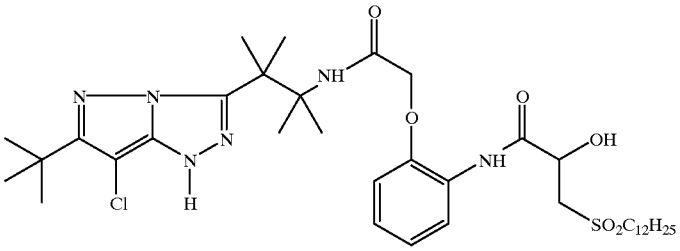 |
| M-79 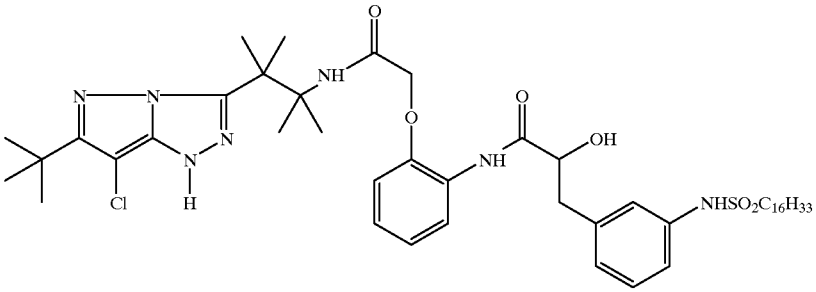 |

TABLE I-continued
| EXAMPLE COUPLERS |
|---|
| M-80 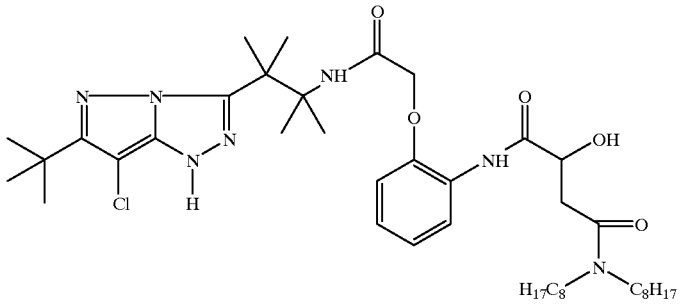 |
| M-81 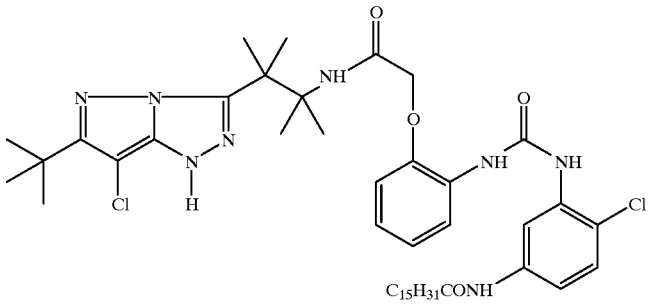 |
| M-82 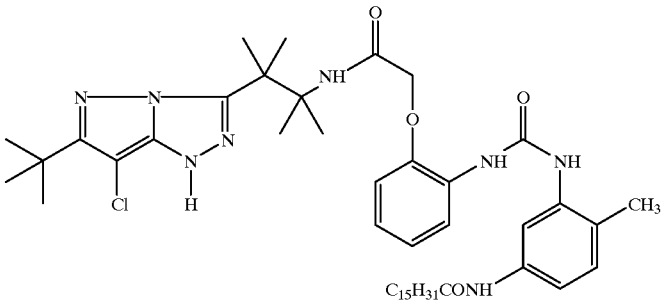 |
| M-83 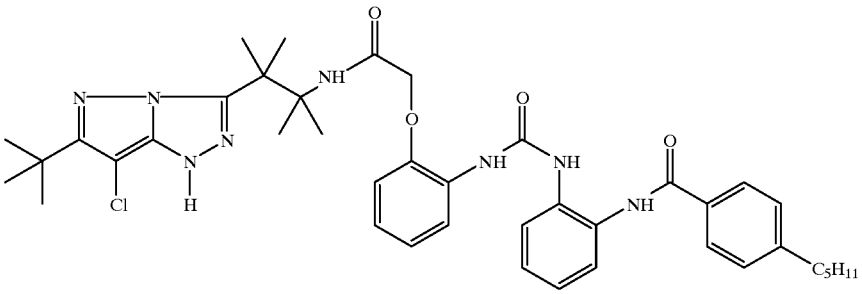 |

TABLE I-continued
| EXAMPLE COUPLERS |
|---|
| M-84 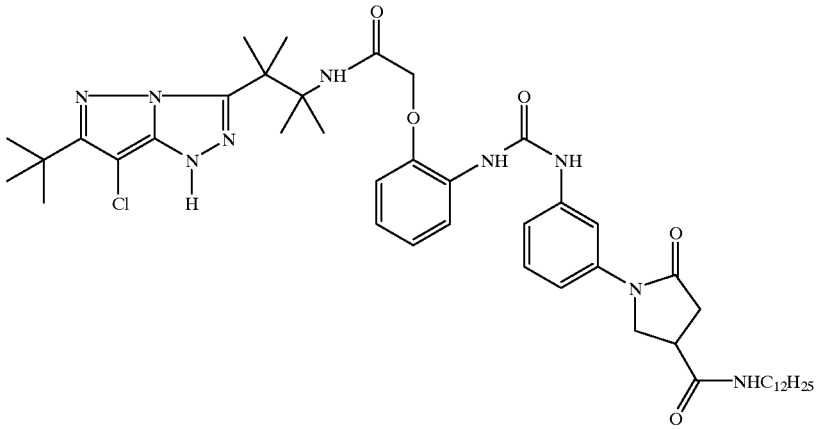 |
| M-85 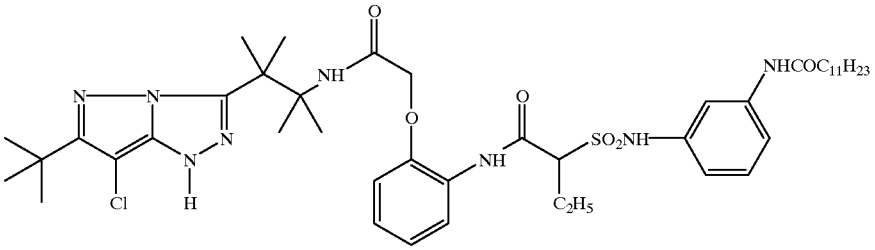 |
| M-86 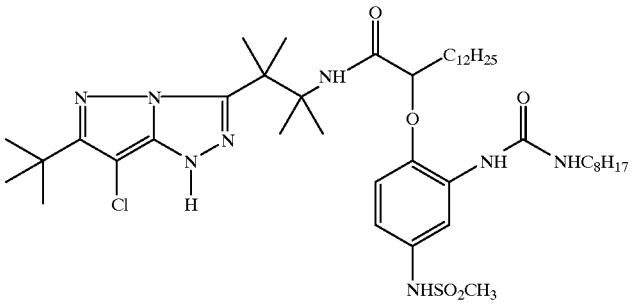 |
| M-87 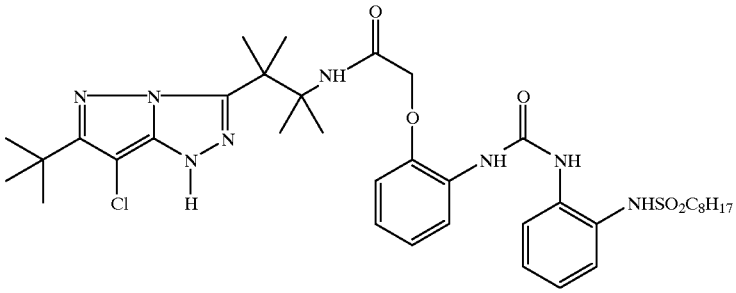 |

TABLE I-continued
| EXAMPLE COUPLERS |
|---|
| M-88 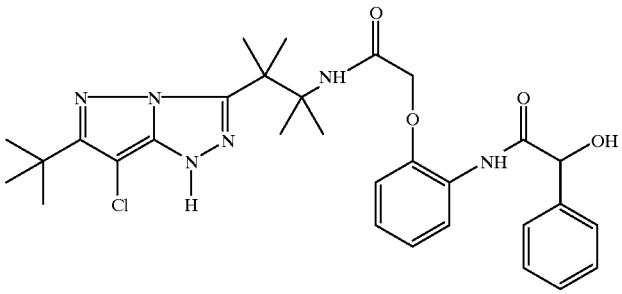 |
| M-89 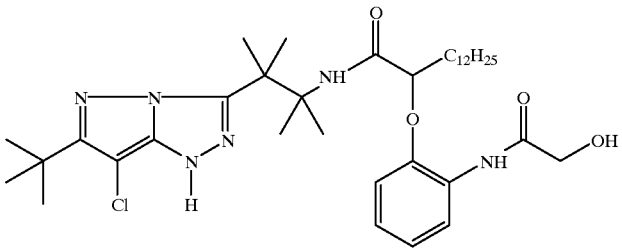 |
| M-90 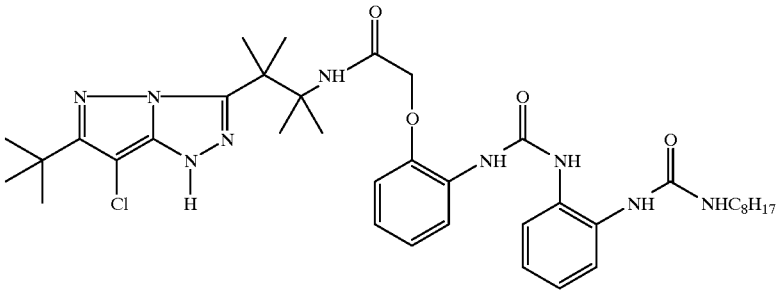 |
| M-91 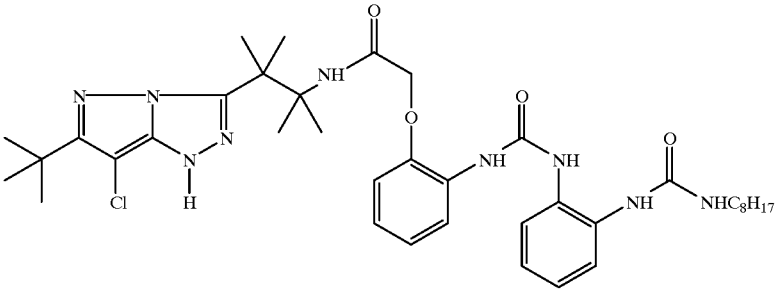 |

TABLE I-continued
| EXAMPLE COUPLERS |
|---|
| M-92 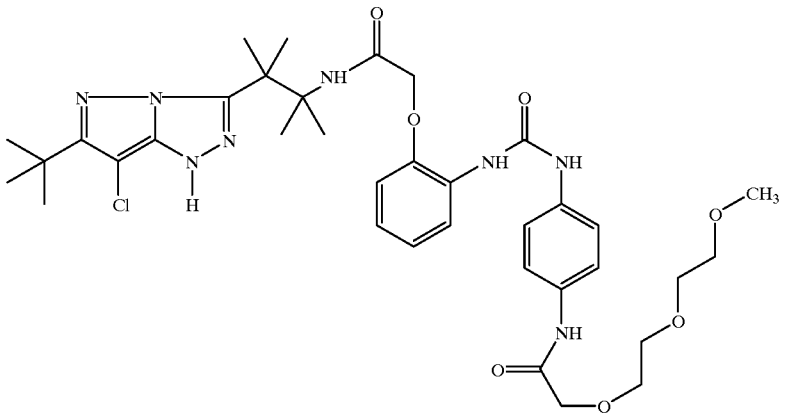 |
| M-93 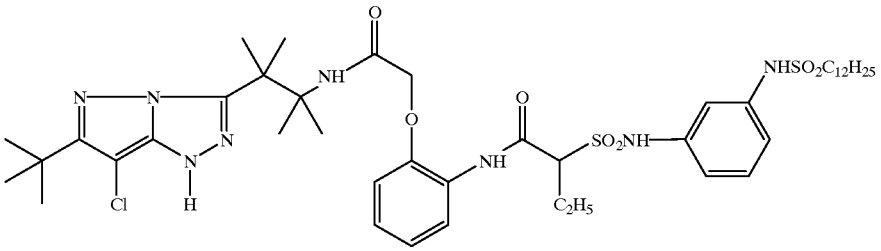 |
| M-94 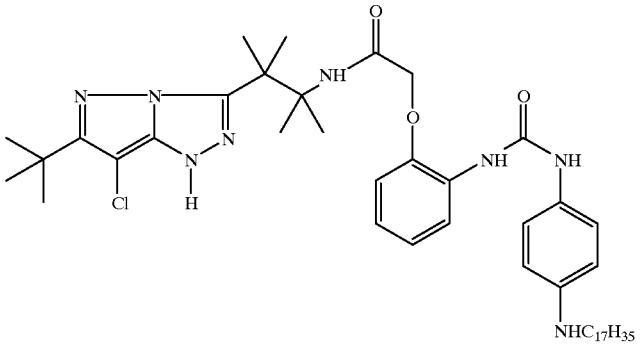 |
| M-95 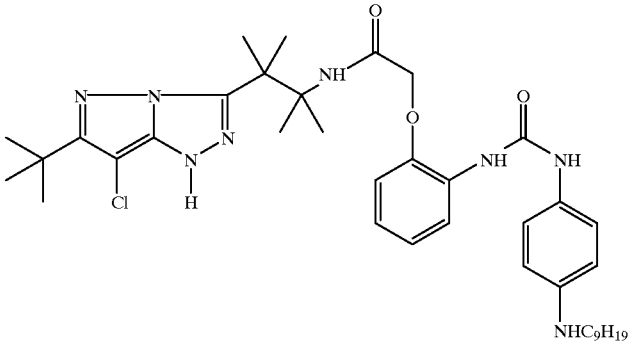 |

TABLE I-continued
| EXAMPLE COUPLERS |
|---|
| M-96 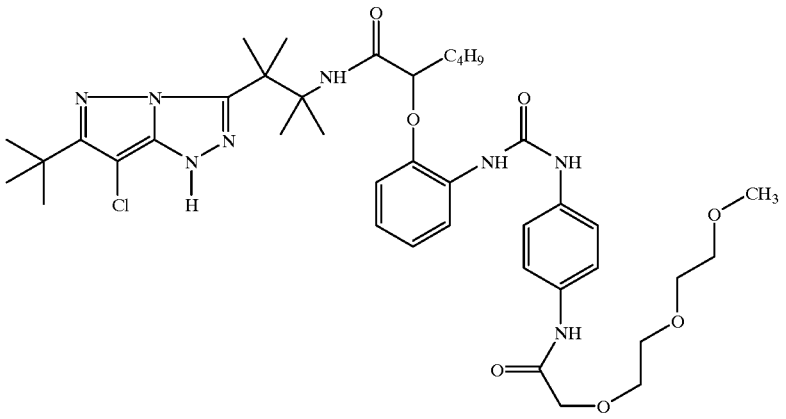 |
| M-97 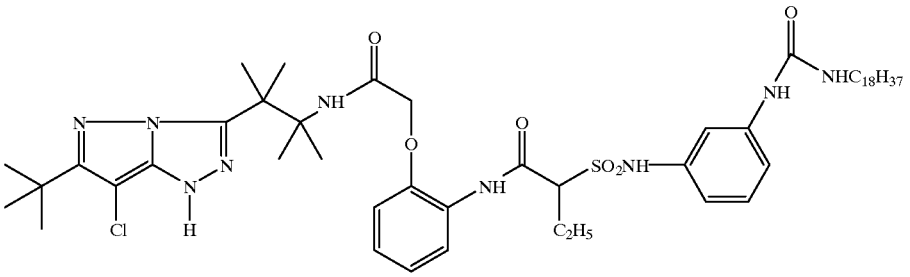 |
| M-98 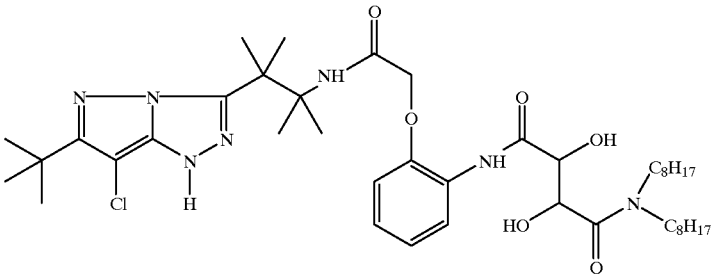 |
| M-99 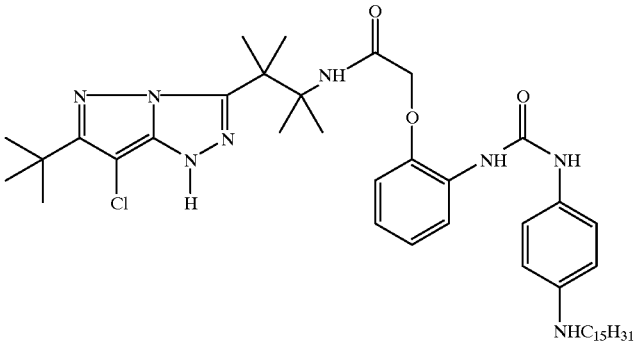 |

TABLE I-continued
| EXAMPLE COUPLERS |
|---|
| M-100 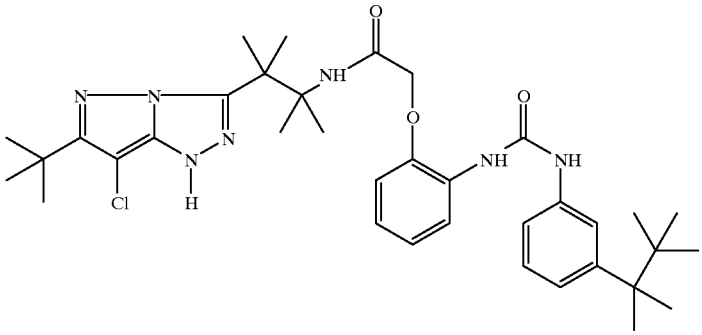 |
| M-101 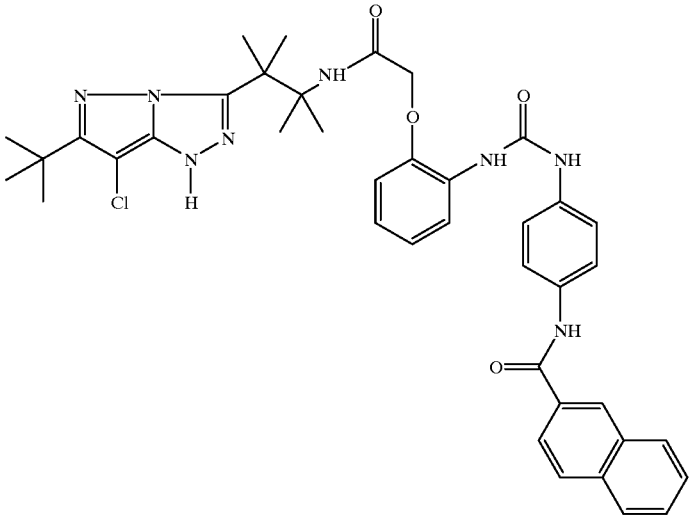 |
| M-102 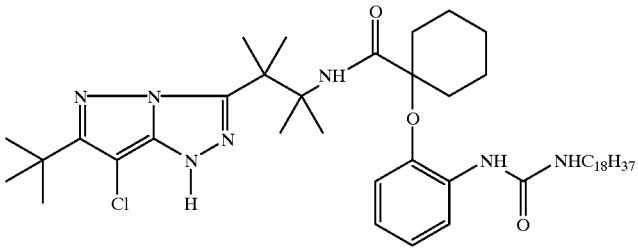 |
| M-103 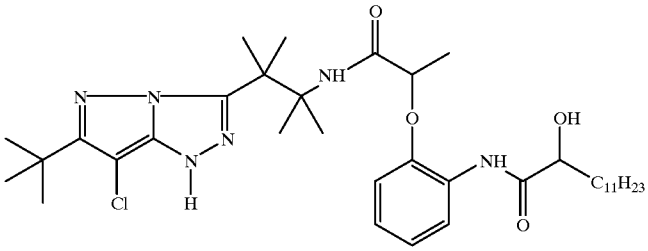 |

TABLE I-continued
| EXAMPLE COUPLERS |
|---|
| M-104 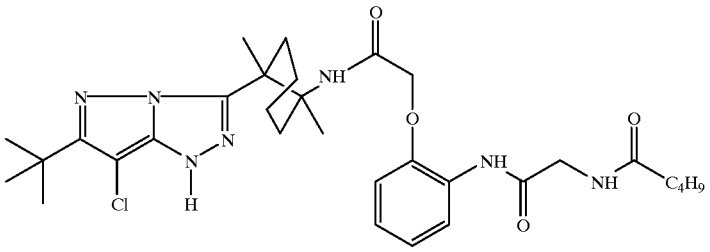 |
| M-105 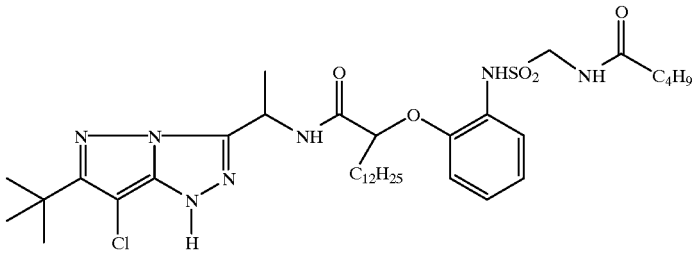 |
| M-106 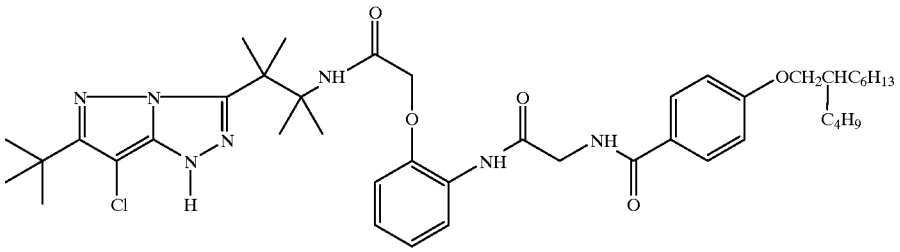 |
| M-107 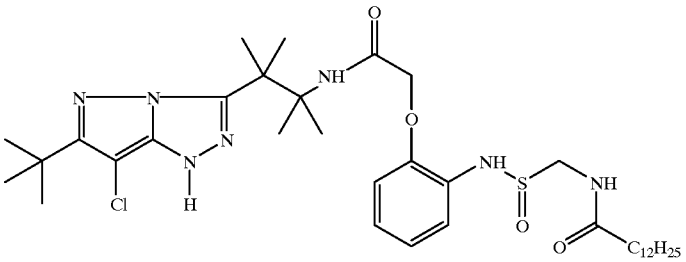 |
| M-108 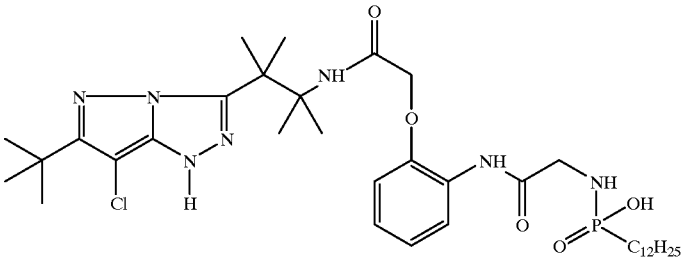 |

TABLE I-continued

| EXAMPLE COUPLERS |
|---|
| M-109 |
| M-110 |
| M-111 |

The couplers of this invention possess ballast groups that impart flat or negative color developer pH sensitivity. These groups also tend to bathochromically shift the $\lambda_{max}$ of most of their photographic dyes into the range especially useful for color reversal films. In addition, the resulting bicyclic azole image dyes have narrow bandwidths that allow high color saturation.

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight, branched chain or cycloalkyl, such as methyl, trifluoromethyl, ethyl, t-butyl, 3-(2,4-di-t-pentylphenoxy) propyl, cyclohexyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl including all aromatic compounds such as phenyl, 4-t-butylphenyl, 2,4,6-trimethylphenyl, and naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamnino, phenylcarbonylamino, 2,5-(di-t-pentylphenyl) carbonylamino, p-dodecyl-phenylcarbonylamino, p-tolylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfmyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1-(N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, and releasing or releasable groups. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials useful in the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office. When it is desired to employ the inventive materials in a small format film, *Research Disclosure*, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The Sections hereinafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifing addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A.

Image dye-forming couplers may be included in the element such as couplers that form cyan dyes upon reaction with oxidized color developing agents which are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651 286; EPO 0 690 344; German OLS 4,026,903; German OLS 3,624,777. and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; U.S. Pat. Nos. 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 0 347,235; EPO 0 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646 841, EPO 0 656 561; EPO 0 660 177; EPO 0 686 872; WO 90/10253; WO 92/09010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912,265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474;. 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632,345; 3,928,041; 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, may be useful. Also contemplated is use in association with nucleating agents, development accelerators or their precursors (UK Patent 2,097,140; UK. Patent 2,131,188); electron transfer agents (U.S. Pat. No. 4,859,578; U.S. Pat. No. 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the materials useful in the invention may be blocked or coated in protected form as described, for example, in Japanese Application 61/258,249 or U.S. Pat. No. 5,019, 492.

The invention may further be used in combination with image-modifying compounds that release PUGS such as "Developer Inhibitor-Releasing" compounds (DIR's). DIR's useful in conjunction with the invention are known in the art and examples are described in U.S. Pat. Nos. 3,137, 578; 3,148,022; 3,148,062; 3,227,554; 3,384,657; 3,379, 529; 3,615,506; 3,617,291; 3,620,746; 3,701,783; 3,733, 201; 4,049,455; 4,095,984; 4,126,459; 4,149,886; 4,150, 228; 4,211,562; 4,248,962; 4,259,437; 4,362,878; 4,409, 323; 4,477,563; 4,782,012; 4,962,018; 4,500,634; 4,579, 816; 4,607,004; 4,618,571; 4,678,739; 4,746,600; 4,746, 601; 4,791,049; 4,857,447; 4,865,959; 4,880,342; 4,886, 736; 4,937,179; 4,946,767; 4,948,716; 4,952,485; 4,956, 269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362, 870; 365,252; 365,346; 373,382; 376,212; 377,463; 378, 236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969). Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

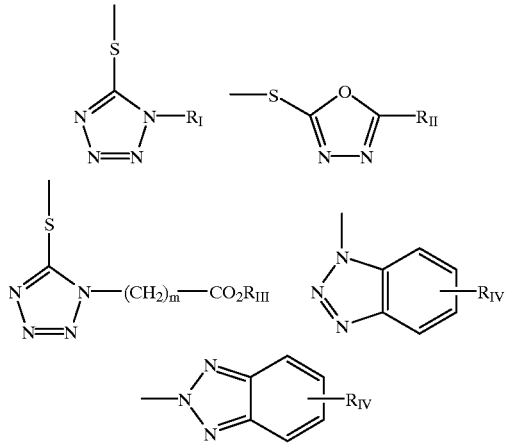

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features describe above. It is typical that the timing group is of one of the formulas:

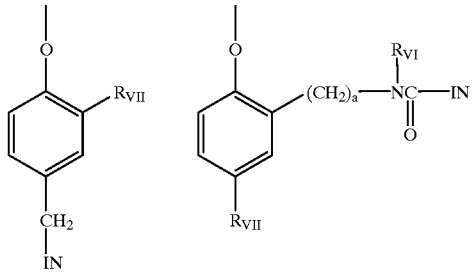

wherein IN is the inhibitor moiety, $R_{VII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

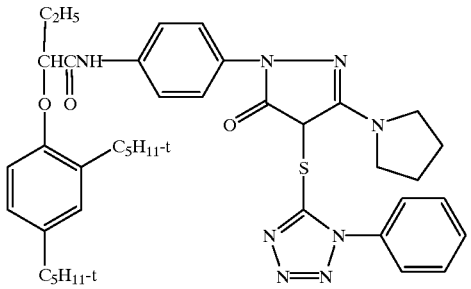

-continued

D2

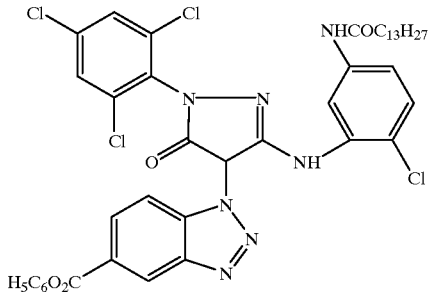

D3

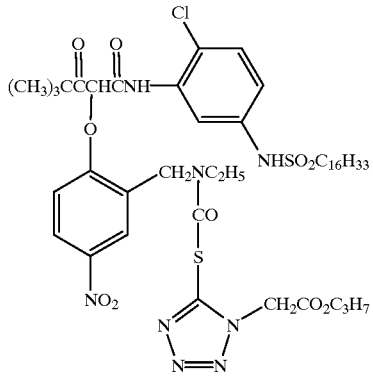

D4

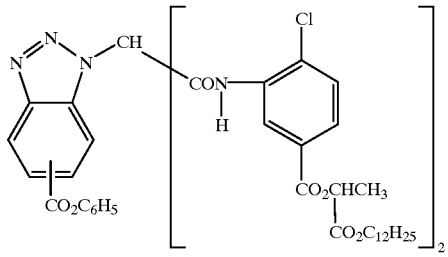

D5

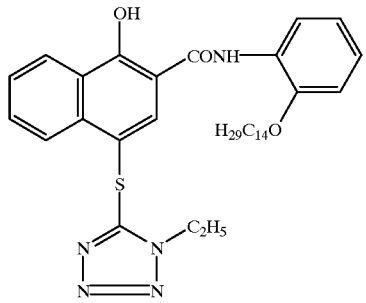

D6
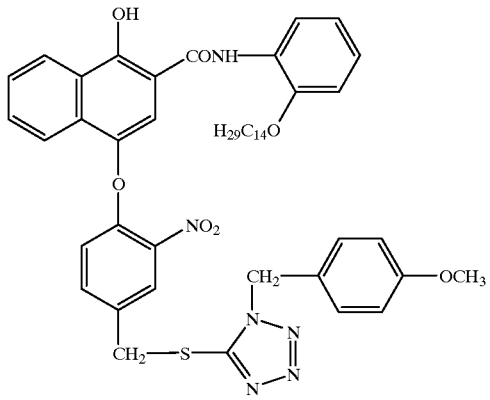
D7
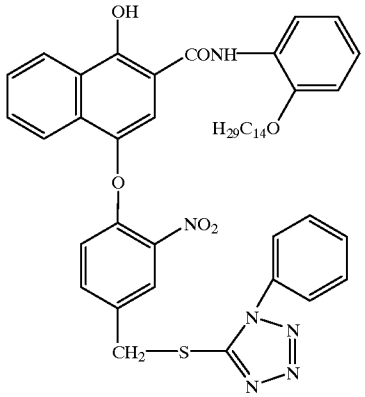
D8
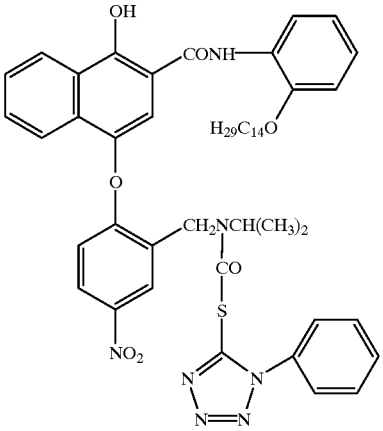
D9
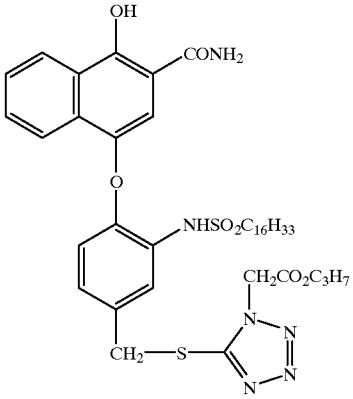
D10
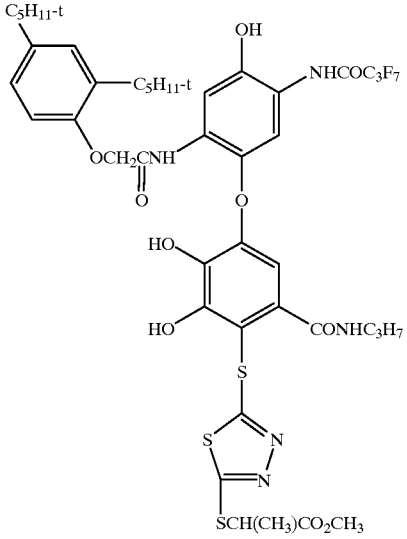
D11
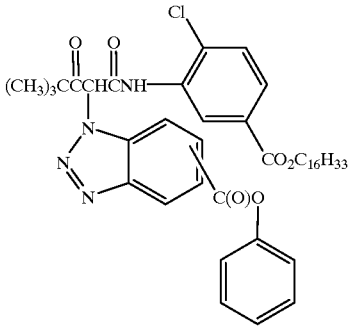

-continued

D12

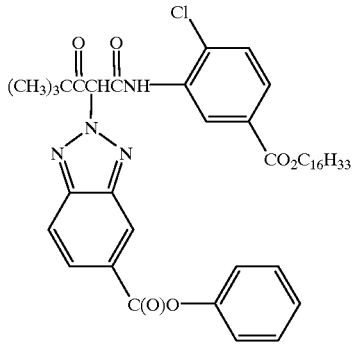

It is also contemplated that the present invention may be employed to obtain reflection color prints as described in *Research Disclosure*, November 1979, Item 18716, available from Kenneth Mason Publications, Ltd, Dudley Annex, 12a North Street, Emsworth, Hampshire P0101 7DQ, England. Materials useful in the invention may be coated on pH adjusted support as described in U.S. Pat. No. 4,917,994; on a support with reduced oxygen permeability (EP 553, 339); with epoxy solvents (EP 164,961); with nickel complex stabilizers (U.S. Pat. No. 4,346,165; U.S. Pat. No. 4,540,653 and U.S. Pat. No. 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072,634; 90-077,822; 90-078,229; 90-078,230; 90-079,336; 90-079,337; 90-079,338; 90-079,690; 90-079,691; 90-080,487; 90-080,488; 90-080,489; 90-080,490; 90-080,491; 90-080,492; 90-080,494; 90-085,928; 90-086,669; 90-086,670; 90-087,360; 90-087,361; 90-087,362; 90-087,363; 90-087,364; 90-088,097; 90-093,662; 90-093,663; 90-093,664; 90-093,665; 90-093,666; 90-093,668; 90-094,055; 90-094,056; 90-103,409; 83-62,586; 83-09,959.

Conventional radiation-sensitive silver halide emulsions can be employed in the practice of this invention. Such emulsions are illustrated by *Research Disclosure*, Item 38755, September 1996, I. Emulsion grains and their preparation.

Especially usefuil in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye. If desired "Redox Amplification" as described in Research Disclosure XVIIIB(5) may be used.

A "color negative element" utilizes negative-working silver halide and provides a negative image upon processing. A first type of such element is a capture element, which is a color negative film that is designed for capturing an image in negative form rather than for viewing an image. A second type of such an element is a direct-view element that is designed, at least in part, for providing a positive image viewable by humans.

In the capture element, speed (the sensitivity of the element to low light conditions) is usually critical to obtaining sufficient image in such elements. Such elements are typically silver bromoiodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3' 15" or less and desirably 90 or even 60 seconds or less.

A direct-view photographic element is one which yields a color image that is designed for human viewing (1) by reflected light, such as a photographic paper print, (2) by transmitted light, such as a display transparency, or (3) by projection, such as a color slide or a motion picture print. These direct-view elements may be exposed and processed in a variety of ways. For example, paper prints, display transparencies, and motion picture prints are typically produced by digitally printing or by optically printing an image from a color negative onto the direct-viewing element and processing though an appropriate negative-working photographic process to give a positive color image. The element may be sold packaged with instructions for digital printing or for processing using a color negative optical printing process, for example the Kodak RA-4 process, as generally described in PCT WO 87/04534 or U.S. Pat. No. 4,975,357, to form a positive image. Color projection prints may be processed, for example, in accordance with the Kodak ECP-2 process as described in the H-24 Manual. Color print development times are typically 90 seconds or less and desirably 45 or even 30 seconds or less. Color slides may be produced in a similar manner but are more typically produced by exposing the film directly in a camera and processing through a reversal color process or a direct positive process to give a positive color image. The foregoing images may also be produced by alternative processes such as digital printing.

Each of these types of photographic elements has its own particular requirements for dye hue, but in general they all require cyan dyes whose absorption bands are less deeply absorbing (that is, shifted away from the red end of the spectrum) than color negative films. This is because dyes in direct-view elements are selected to have the best appearance when viewed by human eyes, whereas the dyes in image capture materials are designed to best match the needs of the printing process.

A reversal element is capable of forming a positive image without optical printing. To provide a positive (or reversal) image, the color development step is preceded by development with a non-chromogenic developing agent to develop exposed silver halide, but not form dye, and followed by uniformly fogging the element to render unexposed silver halide developable. Such reversal elements are typically sold packaged with instructions to process using a color reversal process such as the Kodak E-6 process as described in The British Journal of Photography Annual of 1988, page 194. Alternatively, a direct positive emulsion can be employed to obtain a positive image.

The above elements are typically sold with instructions to process using the appropriate method such as the mentioned color negative (Kodak C-41), color print (Kodak RA-4), or reversal (Kodak E-6) process.

The photographic element of the invention can be incorporated into exposure structures intended for repeated use or exposure structures intended for limited use, variously referred to by names such as "single use cameras", "lens with film", or "photosensitive material package units".

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the patents and other publications referred to in this specification and in the identified Research Disclosure publications are incorporated herein by reference.

SYNTHESIS

The coupler of the invention is readily prepared through conventional techniques. See for example U.S. Pat. No. 5,925,503 for a suitable method.

Synthesis Example-Coupler M-17
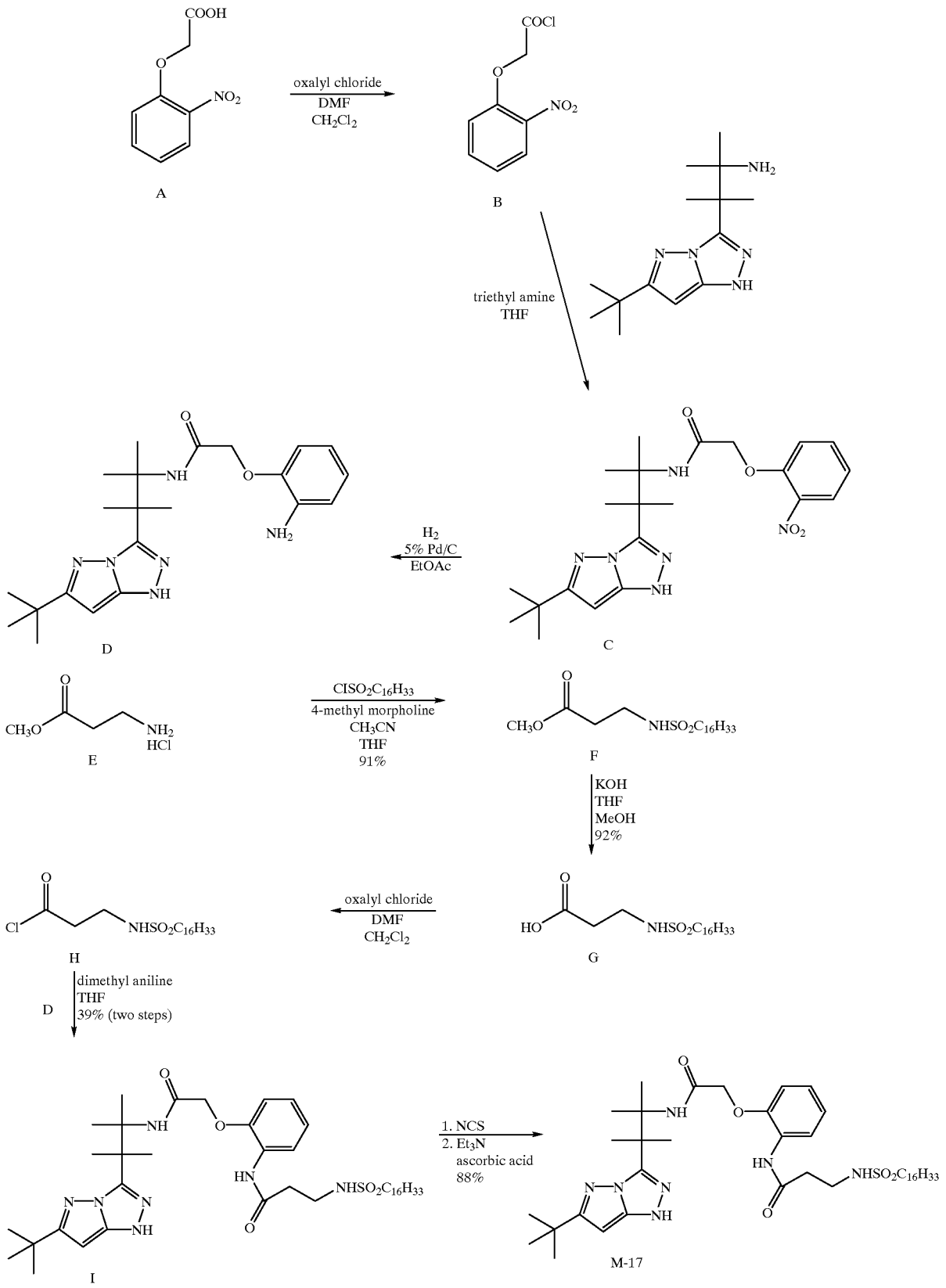

Synthesis of Compound B

Stir the acid (compound A) (985.7 g, 5.0 mol) in methylene chloride (4L). Add DMF (10 mL) then oxalyl chloride (654 mL, 7.5 mol) over a 1 hour period. Stir overnight. Concentrate the solution, then dissolve in cyclohexane (500 mL) and concentrate, repeat 3 times. Dissolve in THF (1L) and use in next step.

Synthesis of Compound C

Stir pyrazolotriazolo amine (1316.5 g, 5.0 mol) in THF (1L). Add triethyl amine (727 mL, 5.25 mol) and cool the mixture to 13 C. Add compound B in THF (1L) from previous reaction over a 1 hour period. Allow to warm to room temperature, and stir for 2 days. Filter solid. Concentrate the solution and add to a mixture of water (8L) and concentrated HCl (500 mL). Extract the aqueous layer with ethyl acetate (2L) three times. Dry the organic layers with $MgSO_4$, filter, and concentrate. Solid compound J (1632 g, 73%)

Synthesis of Compound D

Dissolve compound C (1628 g, 3.68 mol) in ethyl acetate (14.8L). Add 5% Pd/C (76 g). Place under hydrogen atmosphere (580 psi) at 35 C for 2.5 hours. Filter then concentrate the mixture. Recrystallize from acetonitrile (1244 g, 82%)

Synthesis of Compound F

Stir β-alanine methyl ester hydrochloride (7.0 g, 50.1 mmol) in acetonitrile/THF (72 mL/12 mL). Cool the mixture to 0 C, and add 4-methyl morpholine (10.1 mL, 91.9 mmol), then hexadecanesulfonyl chloride (13.6 g, 41.8 mmol). Stir overnight allowing to warm to room temperature. Add concentrated HCl (20 mL), ethyl acetate (200 mL), and water (300 mL). Wash the organic phase twice with water (300 mL), and then with brine (200 mL). Dry the organic solution with $MgSO_4$, filter, and evaporate to an off-white solid (15 g, 91%).

Synthesis of Compound G

Stir the ester (compound F) (6.4 g, 16.3 mmol) in THF/methanol (20 mL/20 mL). Add a solution of potassium hydroxide (1.9 g, 34.3 mmol) in water (20 mL). Stir the mixture for 5 hours. Add hydrochloric acid (3M, 100 mL) and stir for 1 hour. Extract the aqueous layer with ethyl acetate (100 mL) two times. Dry the organic layers with $MgSO_4$, filter, and concentrate. Azetrope the solid with toluene (100 mL) three times. (5.7 g, 92%)

Synthesis of Compound H

Stir the acid (compound G) (5.7 g, 15.1 mmol) in THF (150 mL). Add oxalyl chloride (2.6 mL, 30.2 mmol). Add DMF(4 drops, cat.). After 4 hours concentrate solution and azetrope with toluene (100 mL) three times. Use in next reaction Synthesis of Compound I Stir the acid chloride (compound H) (6.0 g, 15.1 mmol) in THF(150 mL). Add dimethyl aniline (2.9 mL, 22.6 mmol). Cool the reaction mixture to 0 C, then add compound D (6.2 g, 15.1 mmol). After stirring overnight, add HCl (3M, 100 mL) and extract with ethyl acetate (100 mL) three times. Dry the organic layers with $MgSO_4$, filter, and concentrate. Purify by flash silica gel column chromatography (40% ethyl acetate/60% heptane) to provide an off-white solid (4.6 g, 39%).

Synthesis of Compound M-17

Stir the coupler (compound I) (4.6 g, 6.0 mmol) in methylene chloride (30 mL). Add N-chlorosuccinimide (1.7 g, 12.5 mmol). After 4 hours add triethyl amine (2.5 mL, 17.9 mmol), then ascorbic acid (3.1 g, 17.9 mmol). Stir overnight. Add reaction mixture to HCl (3M, 50 mL). Extract aqueous layer with ethyl acetate (50 mL) three times. Dry the organic layers with $MgSO_4$, filter, and concentrate. Recrystallize the product from ethyl acetate to give a white solid (4.2 g, 88%, m.p. 167–168 C).

Photographic Coatings

On a gel-subbed, acetate support were coated the following layers:

First Layer:

A photosensitive layer containing (per square meter) 3.23 g gelatin, 1.08 g sensitized silver bromo-iodide red-sensitized emulsion, a coupler dispersion containing $2.69\times 10^{-3}$ mole of cyan coupler C-1, 0.029 g surfactant Olin 10G, and 0.054 g surfactant Triton X-200. The coupler dispersion contained the coupler, coupler solvent (coupler:solvent 1:0.5 di-n-butyl phthalate), gelatin, and surfactant Alkanol XC at a level equal to 10% of the weight of the gelatin in the dispersion.

Second Layer:

An interlayer containing (per square meter) 3.23 g gelatin, 0.11 g oxidized-developer scavenger OS-1, 0.065 g magenta filter dye MFD-1, 0.029 g surfactant Olin 10G, and 0.054 g surfactant Triton X-200.

Third Layer:

A photosensitive layer containing (per square meter) 4.09 g gelatin, 1.08 g sensitized silver bromo-iodide green-sensitized emulsion, a coupler dispersion containing $2.69\times 10^{-3}$ mole of magenta coupler, 0.029 g surfactant Olin 10G, 0.054 g surfactant Triton X-200. The coupler dispersion contained the coupler, coupler solvent phosphoric acid, tris(methylphenyl) ester (coupler:solvent: 1:0.5), gelatin, and Alkanol XC at a level equal to 10% of the weight of the gelatin in the dispersion.

Fourth Layer:

A protective layer containing (per square meter) 3.23 g gelatin, 0.26 g bis(vinylsulfonyl)methane, 0.029 g surfactant Olin 10G, and 0.054 g surfactant Triton X-200.

C-1

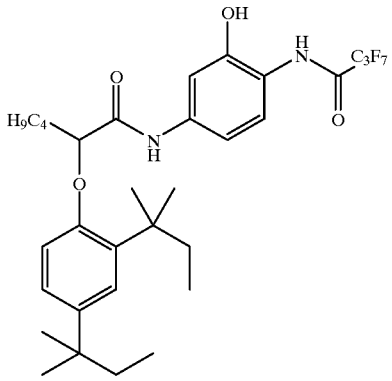

OS-1

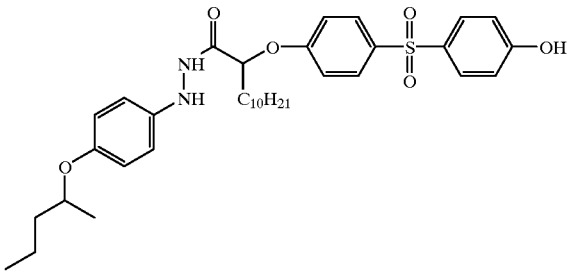

MFD-1

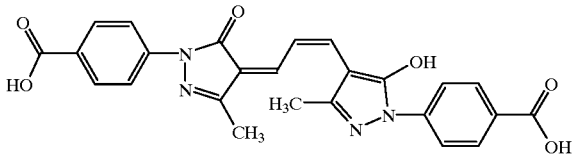

Exposure and Processing

The samples were subjected to a red flash exposure plus a stepwise green exposure using the following conditions:

Green step: 0.02 seconds, 0–3 step wedge, HA-50, WR99 and 0.60 inconel filters

Red flash: 0.02 seconds, no step wedge, HA-50, WR29 and 0.00 inconel filters

Samples were then processed using Kodak E-6® process solutions and conditions as follows:

| Process Step | Time (min.) | Temp (° C.) | Agitation |
|---|---|---|---|
| 1st developer | 3.0 | 36.9 | $N_2$ burst (2" on, 8" off) |
| 1st wash | 2.0 | 36.9 | Running tap water |
| Reversal Bath | 2.0 | 36.9 | None |
| Color Developer* | 6.0 | 36.9 | $N_2$ burst (2" on, 8" off) |
| Pre-bleach | 2.0 | 36.9 | None |
| Bleach | 6.0 | 36.9 | Continuous Air |
| Fixer | 4.0 | 36.9 | Air burst (2" on, 8" off) |
| Final Wash | 4.0 | 36.9 | None |

*pH = 11.60, 11.90 or 12.20

For pH sensitivity, coatings were processed with three different color developers, keeping the rest of the process constant. The three color developers were identical except for the pH: pH=11.60, 11.90 and 12.20. The green $D_{max}$ obtained for a film processed in the process utilizing the pH 11.60 color developer is subtracted from the green $D_{max}$ for the same film processed in the corresponding pH 12.20 color developer process to yield a $\Delta D_{max}$ pH sensitivity metric. Films processed in the pH 11.90 process were used to measure the $\lambda_{max}$ and bandwidth at the half-maximum absorbance of the magenta image dye spectra. The results are shown in Table II.

Specific examples of couplers useful in the invention and comparative examples are as follows:

TABLE II
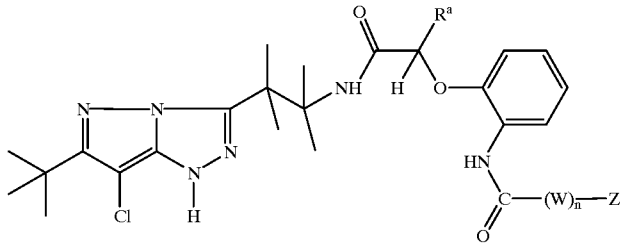
DYE ABSORPTION RESULTS
| Coupler | Ra | n | W | Z | λmax -nm | Half-Band width -nm | pH sens $\Delta D_{max}$ |
|---|---|---|---|---|---|---|---|
| Comp-1 | | | Non-conforming: See formula following Table | | 550 | 88 | −0.48 |
| Comp-2 | H | 0 | — | 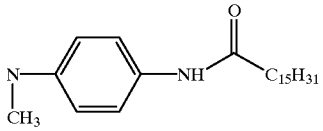 | 545 | 74 | 0.33 |
| Comp-3 | $C_4H_9$ | 1 | —$CH_2$— | 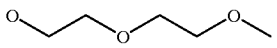 | 545 | 75 | −0.08 |
| Comp-4 | H | 0 | — | —$C_8H_{17}$ | 547 | 74 | 1.37 |
| Comp-5 | H | 1 | —$CH(C_{12}H_{25})$— | 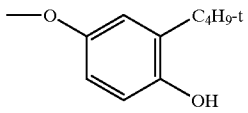 | 548 | 75 | 0.27 |
| Comp-6 | H | 1 | —$CH(C_{10}H_{21})$— | 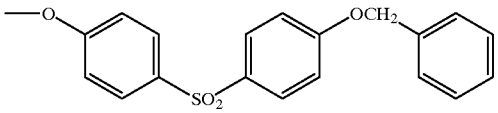 | 548 | 86 | 0.08 |

TABLE II-continued
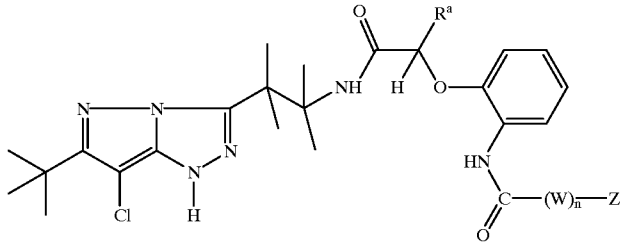
DYE ABSORPTION RESULTS
| Coupler | Ra | n | W | Z | λmax -nm | Half-Band width -nm | pH sens $\Delta D_{max}$ |
|---|---|---|---|---|---|---|---|
| Comp-7 | H | 1 | —$CH_2CH(CH_3)$— | 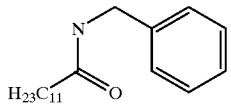 | 551 | 72 | +0.04 |
| Comp-8 | H | 1 | —$CH_2CH(CH_3)$— | 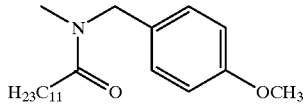 | 551 | 73 | 0.05 |
| Comp-9 | H | 1 | —$CH_2$— | 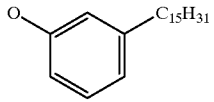 | 551 | 74 | 0.18 |
| Comp-10 | H | 1 | —$CH_2CH_2$— | 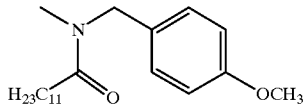 | 552 | 74 | +0.01 |
| Comp-11 | H | 1 | —$CH(C_{12}H_{25})$— | 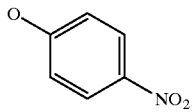 | 552 | 76 | 0.19 |

TABLE II-continued
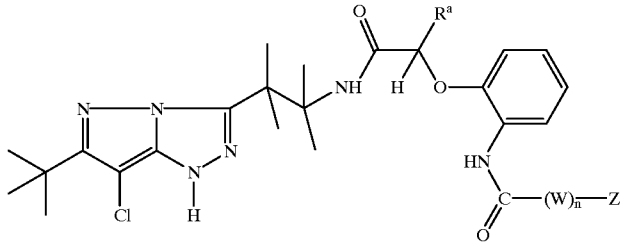
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-35 | H | 1 | —CH(Ph)— | $NHSO_2C_{12}H_{25}$ | 554 | 76 | −0.05 |
| M-36 | H | 1 | —$CH_2$— | 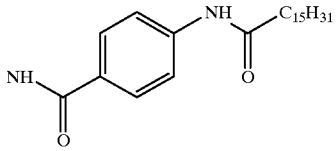 | 554 | 77 | −0.07 |
| M-44 | H | 1 | —$CH_2$— | 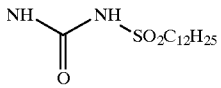 | 554 | 75 | −0.08 |
| M-45 | H | 1 | 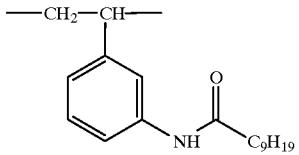 | OH | 554 | 79 | −0.09 |
| M-46 | —$CH_3$ | 0 | — | 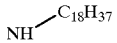 | 555 | 72 | −0.01 |

TABLE II-continued
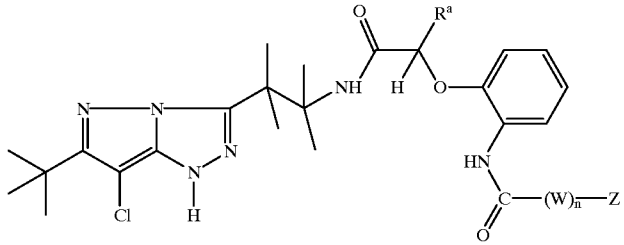
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-47 | H | 1 | —$CH_2$— | 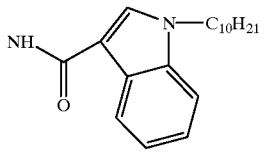 | 555 | 76 | −0.04 |
| M-48 | H | 1 | —$CH_2$— | 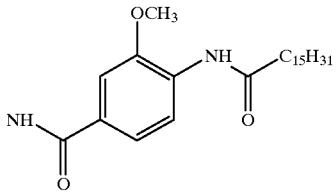 | 555 | 77 | −0.04 |
| M-49 | —$C_4H_9$ | 0 | — | 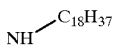 | 555 | 72 | −0.06 |
| M-50 | —$C_2H_5$ | 0 | — | 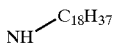 | 555 | 72 | −0.06 |

TABLE II-continued
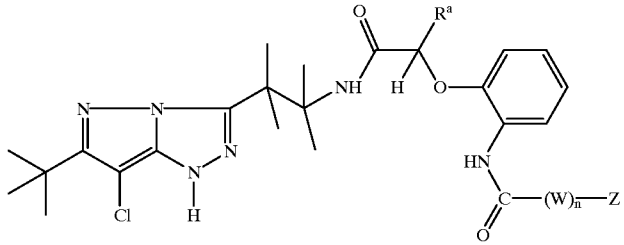
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-51 | H | 1 | —$CH_2$— | 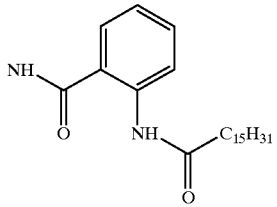 | 555 | 72 | 0.00 |
| M-52 | H | 1 | —$CH_2$— | 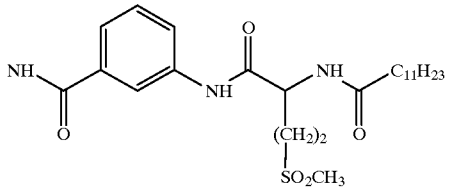 | 55 | 75 | 0.00 |
| M-53 | H | 1 | 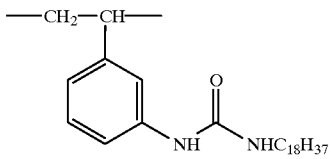 | OH | 555 | 78 | 0.01 |

TABLE II-continued
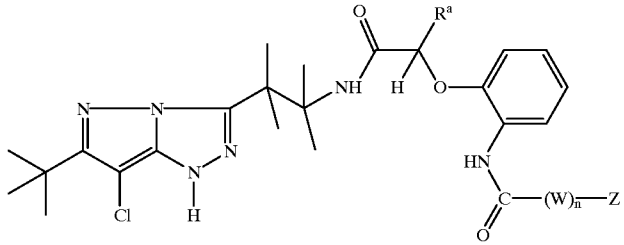
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-54 | H | 1 | 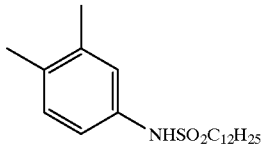 | OH | 555 | 79 | 0.10 |
| M-56 | H | 1 | —$CH_2$— | 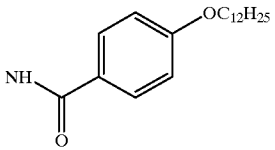 | 555 | 78 | −0.08 |
| M-58 | H | 1 | —$CH_2$ | 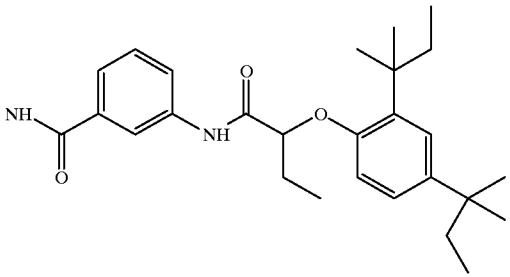 | 556 | 77 | −0.01 |
| M-59 | H | 1 | —$CH_2$— | $NHSO_2$—$C_{16}H_{33}$-n | 556 | 74 | 0.00 |

TABLE II-continued
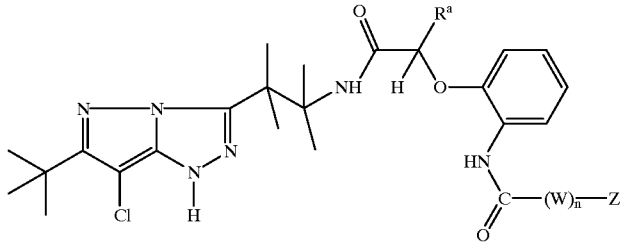
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-60 | H | 1 | —CH(CH$_2$OCH$_2$Ph))— | 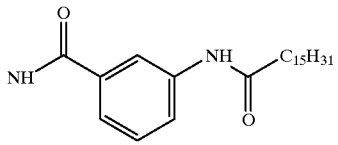 | 556 | 82 | +0.00 |
| M-61 | H | 1 | 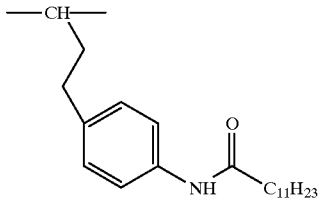 | OH | 556 | 77 | 0.01 |
| M-62 | H | 1 | —CH$_2$— | NHSO$_2$C$_{12}$H$_{25}$ | 556 | 74 | 0.04 |
| M-63 | C$_8$H$_{17}$ | 0 | — | 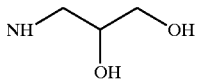 | 556 | 74 | 0.04 |

TABLE II-continued
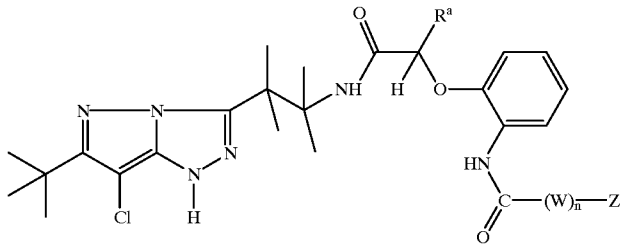
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-66 | H | 1 | 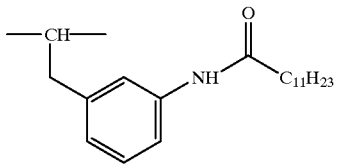 | OH | 556 | 78 | −0.10 |
| M-67 | H | 1 | —CH($CH_2$Ph)— | $NHSO_2C_{12}H_{25}$ | 557 | 75 | −0.16 |
| M-69 | H | 0 | — | 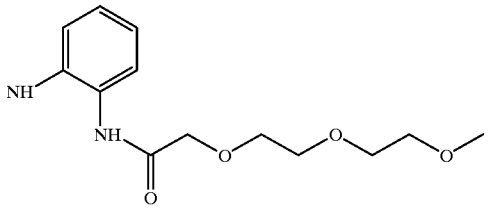 | 557 | 78 | −0.25 |
| M-70 | H | 1 | —$CH_2$— | 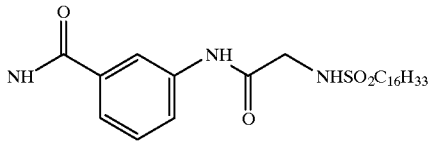 | 557 | 75 | −0.02 |

TABLE II-continued
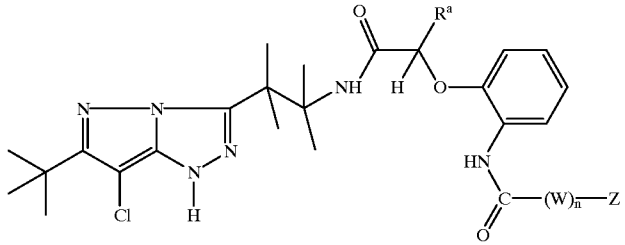
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-71 | H | 1 | —$CH_2$— | 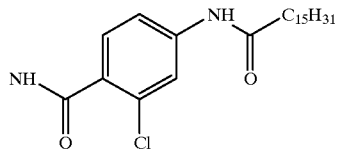 | 557 | 76 | −0.05 |
| M-72 | H | 1 | —$CH_2$— | 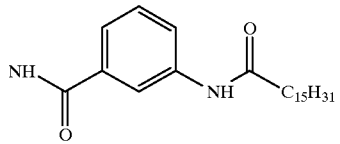 | 557 | 79 | −0.06 |
| M-74 | H | 0 | — | 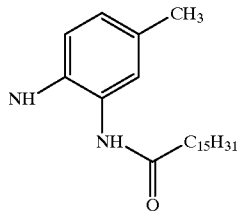 | 558 | 75 | −0.26 |

TABLE II-continued
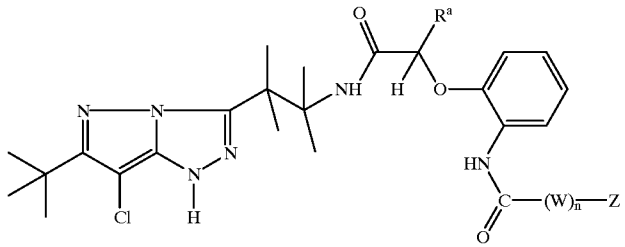
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-75 | H | 0 | — | 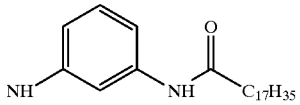 | 558 | 78 | −0.27 |
| M-77 | H | 1 | —$CH_2$— | 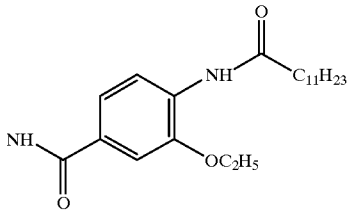 | 558 | 80 | −0.15 |
| M-78 | H | 1 | —$CH(CH_2CH_2SO_2C_{12}H_{25})$— | OH | 558 | 79 | 0.02 |
| M-81 | H | 0 | — | 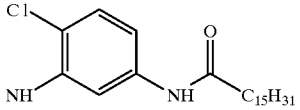 | 559 | 73 | −0.15 |

TABLE II-continued
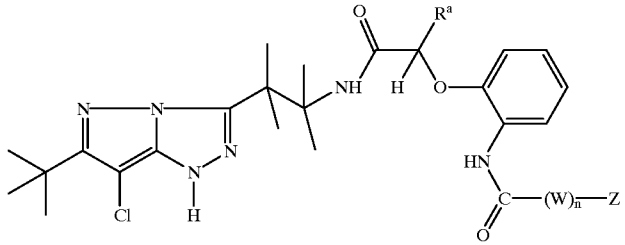
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-82 | H | 0 | — | 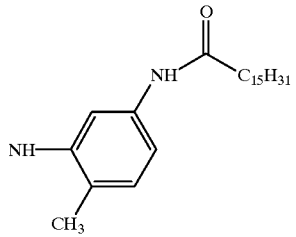 | 559 | 73 | −0.31 |
| M-83 | H | 0 | — | 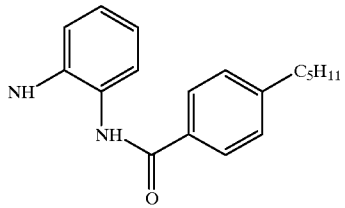 | 559 | 76 | −0.25 |

TABLE II-continued
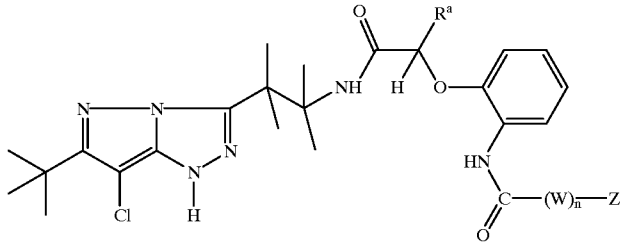
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-84 | H | 0 | — | 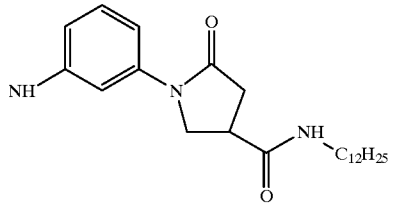 | 559 | 76 | −0.26 |
| M-86 | $C_{12}H_{25}$ | 0 | — | $NHC_8H_{17}$ | 559 | 74 | 0.07 |
| M-87 | H | 0 | — | 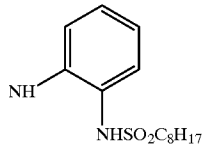 | 559 | 78 | +0.08 |

TABLE II-continued
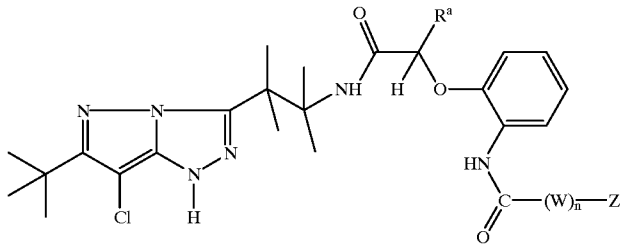
DYE ABSORPTION RESULTS
| Coupler | Ra | n | W | Z | λmax -nm | Half-Band width -nm | pH sens $\Delta D_{max}$ |
|---|---|---|---|---|---|---|---|
| M-106 | H | 1 | —$CH_2$— | 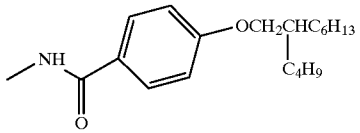 | 555 | 78 | 0 |
| Comp-1 | 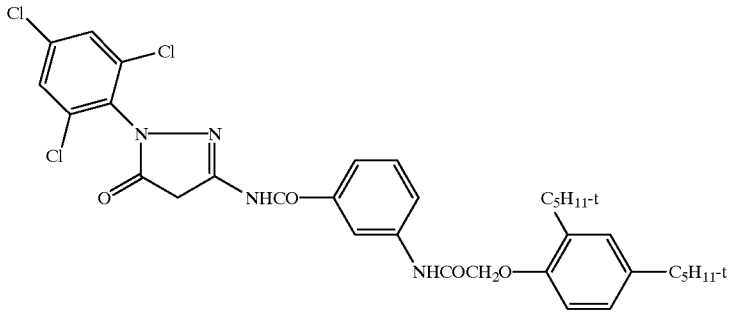 | | | | | | |

The desired ranges for $\lambda_{max}$, half-bandwidth, and pH sensitivity are 553–560, 72–84, and −0.3 to +0.1, respectively. The compounds useful in the invention listed above gave results for $\lambda_{max}$, half-bandwidth and pH sensitivity values that are all within the desired range. In addition to these, many other compounds that fall within the claims of this invention were synthesized and tested. Not all specific couplers gave the desired result for all three properties, but the majority gave results within the desired range for all three criteria. Of the couplers tested, about 3/4 gave desirable $\lambda_{max}$ and desirable pH sensitivity, and 95% were within the desired half-bandwidth range. Thus, the advantageous properties possessed by the generic coupler class are demonstrated.

The entire contents of the patents and other publications referred to in this specification are incorporated herein by reference.

What is claimed is:

1. A photographic element comprising a light-sensitive silver halide emulsion layer having associated therewith a bicyclic azole dye-forming coupler compound having Formula I:

I

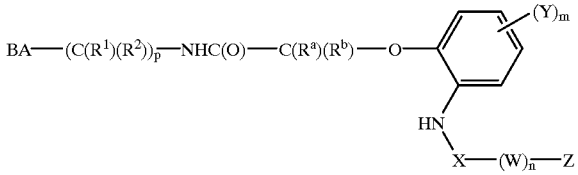

wherein:

BA represents a bicyclic azole coupler nucleus with $—(C(R^1)(R^2))_p—$ bonded to a ring carbon in a non-coupling position of the coupler nucleus;

p is 1 or 2, and each $R^1$ and $R^2$ is independently selected from H and a substituent group, provided that any two of $R^1$ and $R^2$ may join to form a ring;

$R^a$ and $R^b$ are each independently selected from H and a substituent group, provided that substituent groups may join to form a ring;

each Y is an independently selected substituent and m is 0–4;

X is selected from the group consisting of —C(O)—, $—S(O)_2—$, —S(O)—, and —P(O)(OH)—;

W is a connecting group having a chain of up to four atoms between X and Z, and n=0 or 1; and a) when n=0, Z is $—NHR^5$ where $R^5$ is H or a substituent, and b) when n=1, Z is selected from —OH, $—S(O)_2NHR^5$, and $—NHR^6$ where $R^5$ is H or a substituent group and $R^6$ is a substituent bonded to —NH— by an electron withdrawing group in $R^6$;

provided that the ClogP value of the coupler compound is at least 5.0.

2. The element of claim 1 wherein when n=0 and Z is $—NHR^5$.

3. The element of claim 1 wherein n=1 and Z is —OH.

4. The element of claim 1 wherein n=1 and Z is —NHR where $R^6$ is a substituent bonded to —NH— by an electron withdrawing group.

5. The element of claim 4 wherein the electron withdrawing group bonding the rest of $R^6$ to —NH— is selected from the group consisting of —C(O)—, $—S(O)_2—$, —S(O)—, and $—P(O)_2—$.

6. The element of claim 1 wherein n=1 and Z is $—S(O)_2NHR^5$ where $R^5$ is H or a substituent.

7. The element of claim 1 wherein p is 2.

8. The element of claim 7 wherein each $R^1$ and $R^2$ is a methyl group.

9. The element of claim 1 wherein X is —C(O)—.

10. The element of claim 1 wherein X is $—S(O)_2—$.

11. The element of claim 1 wherein BA is a 1H-pyrazolo [5,1-c]-1,2,4 triazole nucleus.

12. The element of claim 1 wherein BA is a 1H-pyrazolo [1,5-b]-1,2,4 triazole nucleus.

13. The element of claim 11 wherein n is 1 and the atoms in the chain of W connecting X and Z are selected from C, O, N, S, and P.

14. The element of claim 13 wherein W is an alkylene group.

15. The element of claim 14 wherein W is a methylene group.

16. The element of claim 15 wherein the methylene group is substituted.

17. The element of claim 15 wherein the methylene group is unsubstituted.

18. The element of claim 11 wherein the Clog P value is at least 6.0.

19. The element of claim 11 wherein X is —C(O)—, n=1, W is an alkylene group, and Z is a carbonamido group.

20. The element of claim 11 wherein X is —C(O)—, n=1, W is an alkylene group, and Z is a sulfonamido group.

21. The element of claim 11 wherein X is —CO—, n=1, W is an alkylene group, and Z is a hydroxy group.

22. The element of claim 11 wherein X is —CO—, n=0, and Z is a carbonamido group.

23. A photographic element as described in claim 1 packaged with instructions to process using reversal processing.

24. The element of claim 1 further comprising an acylacetanilide yellow coupler and a phenolic cyan coupler.

25. A process for forming an image in the element of claim 1 after exposure to light, comprising first subjecting the element to black and white development to develop the silver but not form dye, and subsequently subjecting the element to color development to form dye.

* * * * *